US008032050B2

(12) United States Patent
Nakamura et al.

(10) Patent No.: US 8,032,050 B2
(45) Date of Patent: Oct. 4, 2011

(54) CHARGE ASSEMBLY AND IMAGE FORMATION APPARATUS INCLUDING THE SAME

(75) Inventors: Makoto Nakamura, Ebina (JP); Yutaka Narita, Sagamihara (JP); Tadayuki Oshima, Atsugi (JP); Taisuke Tokuwaki, Sagamihara (JP); Hiroki Furubayashi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 589 days.

(21) Appl. No.: 11/925,446

(22) Filed: Oct. 26, 2007

(65) Prior Publication Data

US 2008/0101819 A1 May 1, 2008

(30) Foreign Application Priority Data

Oct. 27, 2006 (JP) ..... 2006-293121

(51) Int. Cl.
*G03G 15/02* (2006.01)

(52) U.S. Cl. ..... 399/100; 399/174

(58) Field of Classification Search ..... 399/100, 399/168, 174, 176
See application file for complete search history.

(56) References Cited

U.S. PATENT DOCUMENTS

| | | | | |
|---|---|---|---|---|
| 5,146,280 | A | 9/1992 | Kisu | |
| 6,580,889 | B1 * | 6/2003 | Ishiyama et al. | 399/174 |
| 6,697,587 | B2 * | 2/2004 | Harada | 399/111 |
| 7,580,655 | B2 * | 8/2009 | Nukada et al. | 399/176 |
| 2002/0119324 | A1 | 8/2002 | Harashima et al. | |
| 2004/0057749 | A1 | 3/2004 | Saito et al. | |
| 2006/0115292 | A1 | 6/2006 | Sampe et al. | |
| 2007/0196123 | A1 * | 8/2007 | Mizuishi et al. | 399/100 |

FOREIGN PATENT DOCUMENTS

| | | |
|---|---|---|
| JP | 3-52058 | 3/1991 |
| JP | 3-240076 | 10/1991 |
| JP | 8-30915 | 2/1996 |
| JP | 9-197768 | 7/1997 |
| JP | 10-161391 | 6/1998 |
| JP | 11-149201 | 6/1999 |
| JP | 2001-312121 | 11/2001 |
| JP | 2002-244484 | 8/2002 |
| JP | 3356603 | 10/2002 |
| JP | 2005-91818 | 4/2005 |
| JP | 3740354 | 11/2005 |
| JP | 2006-17882 | 1/2006 |
| JP | 2006-098476 | 4/2006 |

OTHER PUBLICATIONS

Office Action issued on Jun. 28, 2011, in counterpart Japanese Patent Application No. 2006-293121.

* cited by examiner

*Primary Examiner* — David M Gray
*Assistant Examiner* — Andrew V Do
(74) *Attorney, Agent, or Firm* — Oblon, Spivak, McClelland, Maier & Neustadt, L.L.P.

(57) ABSTRACT

The charge assembly according to the present invention includes a charge member having a conductive support body on which a resistance adjusting layer and a surface layer covering the resistance adjusting layer are formed, to rotate a surface of the image support body to electrically charge the image support body, the surface layer having a static friction coefficient of 1.0 or more; and a cleaning member rotating the surface layer of the charge member in contact therewith to remove foreign particles on the surface layer.

14 Claims, 9 Drawing Sheets

WITH CLEAN ROLLER

WITH DIRTY ROLLER (IMAGE HAVING VERTICAL LINES)

CHARGE ASSEMBLY AND IMAGE FORMATION APPARATUS INCLUDING THE SAME

PRIORITY CLAIM

The present application is based on and claims priority from Japanese Patent Application No. 2006-293121, filed on Oct. 27, 2006, the disclosure of which is hereby incorporated by reference herein in its entirety.

BACKGROUND OF THE INVENTION

1. Field of the Invention

The present invention relates to improvement and modification in a charge assembly having a charge member for charging an image support body, and an image formation apparatus including the same. In particular, the present invention relates to improvement and modification in a charge assembly suitable for an image formation apparatus such as a copying machine, a laser beam printer, and a facsimile machine.

2. Description of Related Art

There have been known image formation apparatuses of an electrophotographic type such as a copying machine, a laser beam printer, and a facsimile machine. Such an image formation apparatus includes an image support body supporting an electrostatic latent image; an exposure part exposing a surface of the image support body to write an electrostatic latent image on the surface; a developing part visualizing the electrostatic latent image formed on the surface of the image support body; a transfer part transferring the visualized image on a transfer body; a surface cleaning part cleaning the surface of the image support body; a lubricant coating member coating a lubricant on the surface of image support body for preventing the surface of the image support body from cracking; and a charge member electrically charging the surface of the image support body.

FIG. 1 is a pattern diagram showing an example of the above image formation apparatus. The operation thereof will be described with reference to the drawing. In FIG. 1, the number 11 represents a photoreceptor as an image support body to support an electrostatic latent image. Over the photoreceptor 11, the charge assembly 12 is provided for electrically charging the surface 11*a* thereof.

The charge assembly 12 includes a charge roller 12*a* as the charge member, and a cleaning member 12*b* to remove foreign particles on the surface layer by contacting the surface layer of the charge roller 12*a*. The charge roller 12*a* is disposed in contact with the surface 11*a* of the photoreceptor 11 or disposed close to the surface layer 11*a* but in no contact therewith.

An electrostatic latent image is written onto the surface 11*a* of the photoreceptor 11 by exposure light P from a not-shown exposure device.

A developing device 20 is provided forward in a rotational direction of the photoreceptor 11. The developing device 20 has a toner supporter 14 which functions as the developing part to attach a toner 15 to the electrostatic latent image on the photoreceptor 11 for visualization Under the photoreceptor 11, a transfer roller 16 is provided as the transfer part to transfer a visualized image (toner image) formed on the surface 11*a* of the photoreceptor 11 onto a recording paper (recording medium) as the transfer body.

After the transfer processing, the toner remaining on the surface of the photoreceptor 11 is removed by a cleaning member 18 as the surface cleaning part to clean the surface of the image support body. Toner waste 19 is collected in a waste reservoir 21.

Then, in order to reduce friction due to electric discharge from the photoreceptor 11 and improve toner cleaning performance, a lubricant 22 is coated on the surface 11*a* of the photoreceptor 11 by a lubricant coating member 23 after the removal of the toner waste. The lubricant prevents the surface of the image support body from cracking.

Note that FIG. 1 omits showing components generally necessary for other photoelectric processes since they are not directly relevant to the present invention.

The image formation apparatus performs the image formation in the following steps:

(1) The surface 11*a* of the photoreceptor 11 is electrically charged to have a desired electric potential by the charge roller 12*a;*

(2) An electrostatic latent image corresponding to the desired image is formed on the surface 11*a* of the photoreceptor 11 by exposing the surface 11*a* with the exposure device;

(3) The developing device 20 attaches the toner 15 to the electrostatic latent image for visualization, thereby forming a toner image on the surface 11*a* of the photoreceptor 11;

(4) The transfer roller 16 transfers a toner image on the recording paper 17;

(5) The cleaning member 18 removes a toner 18 not transferred on the recording paper 17 and remaining on the surface 11*a;*

(6) The recording paper 17 on which the toner image has been transferred is conveyed to a not-shown fuser device. The fuser device fixes the toner on the recording paper 17 through heating and pressurization; and (7) The lubricant 22 is coated on the surface 11*a* of the photoreceptor 11.

Desired images are repetitively formed on the recoding paper 17 by repeating the above steps (1) to (7).

In order to electrically charge the surface of the photoreceptor 11, there are two known electrification techniques, that is, contact electrification in which the charge roller 12*a* is made in contact with the surface 11*a* of the photoreceptor 11 (disclosed in Japanese Patent Gazette No. Hei 03-052058 and No. Hei 08-030915, etc.) and non-contact electrification in which the charge roller 12*a* is disposed close to the surface 11*a* of the photoreceptor 11 (disclosed in Japanese Patent Application Laid-Open Publication No. Hei 03-240076, No. 2001-312121, and No. 2005-91818). Both of the electrification techniques have the following problems.

(A) Problems in Contact Electrification (a) In the contract electrification, the charge roller 12*a* need be an elastic body. The materials of which the charge roller 12*a* is made are leaked therefrom, attached to the surface 11*a* of the photoreceptor 11, and leaves a trace of the charge roller 12*a* thereon, causing an image to be defective.

(b) The remnant toner and toner components on the photoreceptor 11 are attached to the charge roller 12. Especially, the leakage from the materials of the charge roller 12*a* increases occurrence of the toner attachment, which causes a decrease in the electrification performance of the charge roller 12*a* and generation of defective images.

(c) Deterioration in the surface of the charge roller 12*a* due to the electric discharge further increases the occurrence of the attachment of the toner and toner components, which causes a decrease in the electrification performance of the charge roller 12*a* and generation of defective images.

(B) Problems in Non-Contact Electrification

In view of solving the problems in the contact electrification described in the above items (a) to (c), non-contact electrification has been proposed in which the charge roller 12*a* is disposed close to the 11*a* of the photoreceptor 11 (disclosed in Japanese Patent Application Laid-Open Publication No. Hei 03-240076, No. 2001-312121, and No. 2005-91818).

According to the non-contact electrification technique, the charge roller 12*a* and the photoreceptor 11 are configured to be in no contact with each other, so that it is able to solve the problems of the contact electrification technique, that is, the attachment of the materials of the charge roller 12*a* to the photoreceptor 11 and the attachment of the remnant toner and toner components on the photoreceptor 11 to the charge roller 12*a*.

Moreover, there is a similar technical member to the charge member according to the present invention for providing uniform electrification disclosed in Japanese Patent Application Laid-Open Publication No. Hei 10-161391 and No. Hei 11-149201.

However, the above member for the uniform electrification also has a problem that with application of both of a direct-current (DC) voltage and an alternating-current (AC) voltage, the attachments on the surface 11*a* of the photoreceptor 11 is reciprocatively flown between the charge roller 12*a* and the surface 11*a* of the photoreceptor 11, and attached to the surface of the charge roller 12*a* although they are in no contact with each other.

In particular, when the lubricant 22 made of fluorine resin as PTFE or metallic soap as zinc stearate is coated on the surface 11*a* of the photoreceptor 11 for the purpose of preventing the surface 11*a* from cracking and improving toner cleaning performance, organic compounds with low molecular weight such as the metallic soap are decomposed by the energy from the electric charge (corona discharge) to be attached and accumulated on the charge roller 12*a* over time.

Accumulation of the particles of the toner, toner external additive, and lubricant 22, and the decomposed particles of the lubricant 22 on the surface of charge roller 12*a* over time causes an increase in the resistance thereof, preventing occurrence of the electric discharge. Accordingly, a portion of the surface 11*a* which opposes to a portion of the charge roller 12*a* with the accumulated particles has a lower potential than the surrounding area. When it is imaged, dark lines will appear in the image on the recording paper 17.

The charge assembly has a cleaning member 12*b* to remove attachments from the surface of the charge roller 12*a*. However, there is a problem that the cleaning member 12*b* cannot remove all of the attached particles thereof.

SUMMARY OF THE INVENTION

An object of the present invention is to provide a charge assembly and an image formation apparatus including the same which can reduce the generation of defective images due to the attachments of the toner, toner additive, and lubricant, and the decomposed particles of the lubricant on the surface of the charge member.

A charge assembly according to the present invention includes a charge member having a conductive support body on which a resistance adjusting layer and a surface layer covering the resistance adjusting layer are formed, and rotating a surface of an image support body to electrically charge the image support body on which an electrostatic latent image is formed, the surface layer having a static friction coefficient of 1.0 or more; and a cleaning member rotating the surface layer of the charge member in contact therewith to remove a foreign particle on the surface layer.

The static friction coefficient of the surface layer is preferably, 2.0 or less, or more preferably 1.53 or more and less than 1.60. It is preferable that the surface layer is made of a resin material which contains fluorine or silicon, and that the resin containing fluorine or silicon contains hydroxyl and is condensed by a curing agent to form a condensed product.

Further, the resin material of which the surface layer is made can be formed of a resin in which an ion conductive agent and a polyether-polyol resin are condensed by a curing agent. The ion conductive agent contains alkaline metal or alkaline earth metal.

It is preferable that the charge member has a cylindrical shape, and applied with a direct-current voltage and an alternating-current voltage.

Also, the cleaning member is preferably made of porous melamine resin, and can be made of a sponge material. A circumferential velocity of the cleaning member and that of the charge member are preferably the same. The cleaning member can be configured to be rotated in accordance with rotation of the charge member.

Furthermore, the charge member can be included in an image formation apparatus and disposed closely to the image support body supporting a latent image. The image support body is preferably coated with a lubricant which contains alkaline metal or alkaline earth metal.

DETAILED DESCRIPTION OF THE PREFERRED EMBODIMENTS

Hereinafter, the charge assembly and the image formation apparatus including the charge assembly will be described according to an embodiment of the present invention with reference to the drawings.

Figure 1:
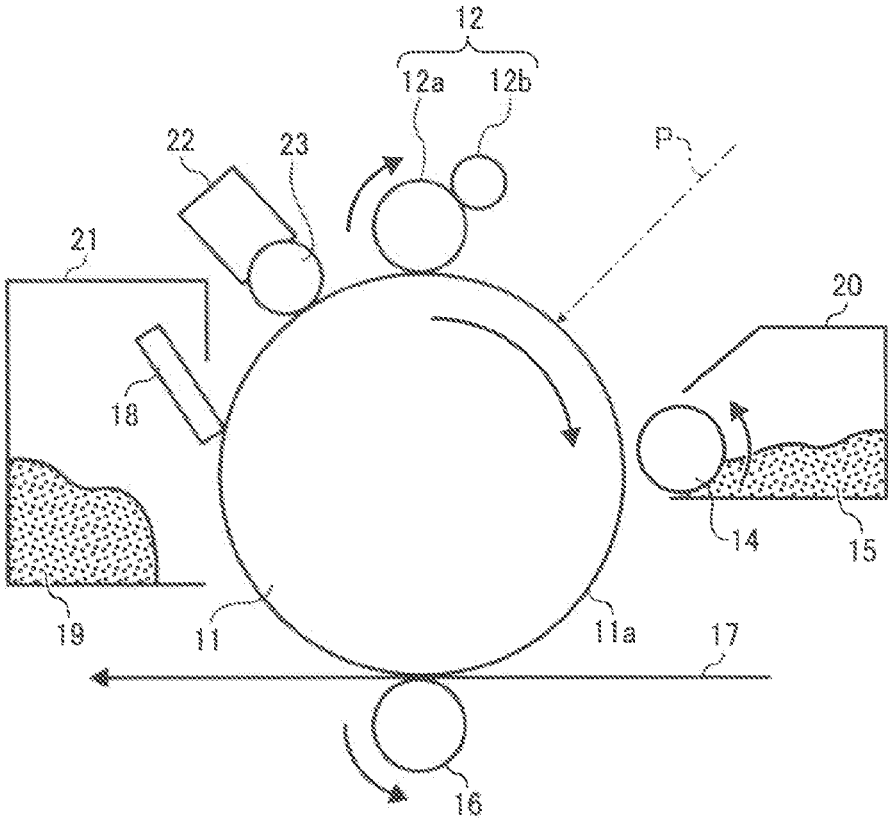
FIG. 1 PRIOR ART
FIG. 1 is a pattern diagram showing an example of a prior art image formation apparatus.
Figure 2:
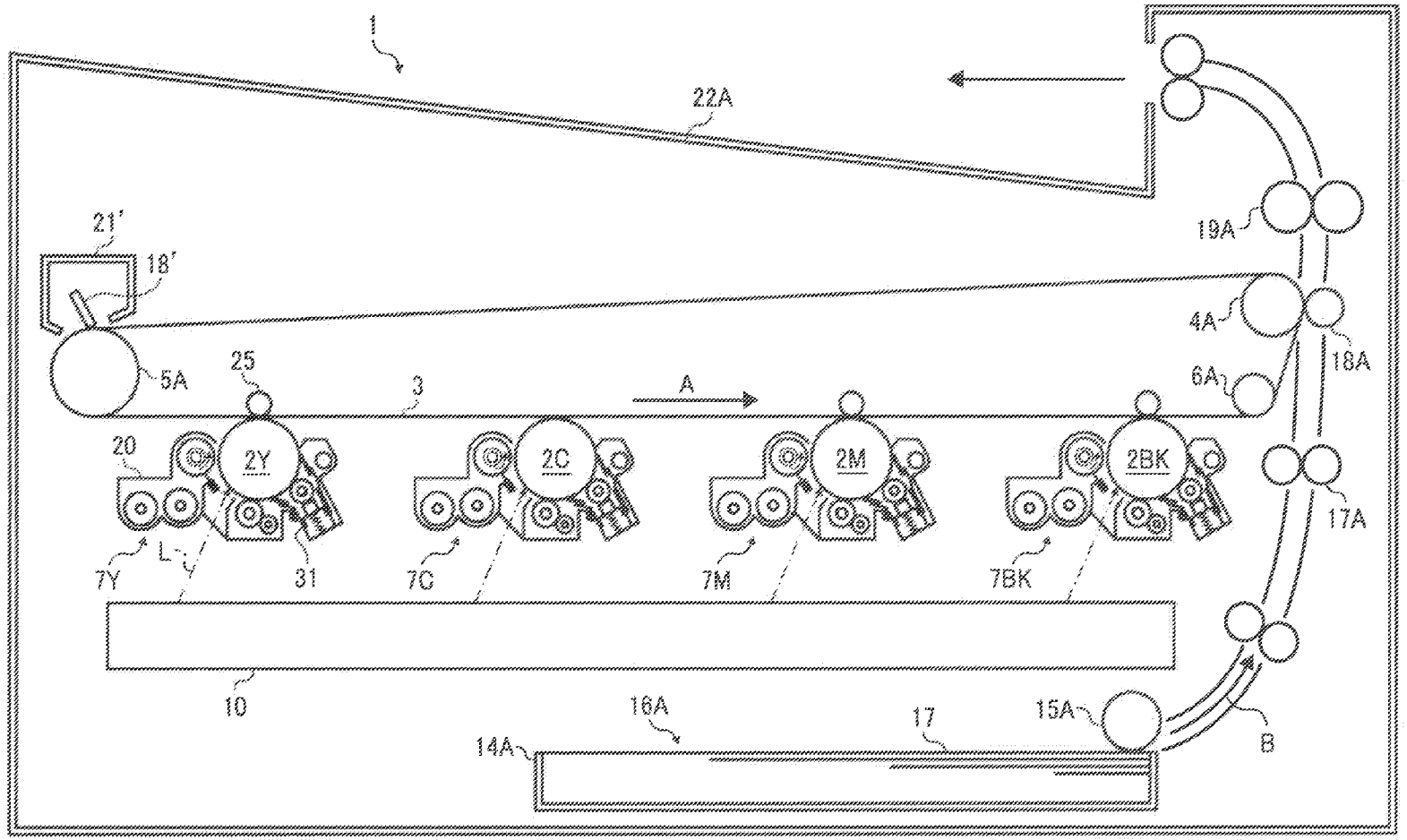
FIG. 2 is a schematic diagram showing an example of the image formation apparatus for forming full color images according to the present invention.

FIG. 2 is a vertical cross-section view showing an example of the image formation apparatus for forming full color images. The image formation apparatus has a plurality of support rollers 4A, 5A, and 6A, an intermediate transfer belt 3 which has no ends and is reeled up over the support rollers 4A, 5A, and 6A and rotationally driven in a direction of the arrow A, and first to fourth process cartridges 7Y, 7C, 7M, and 7BK which are disposed in opposition to the intermediate transfer belt 3. The process cartridges 7Y, 7C, 7M, and 7BK have drum-type image support bodies 2Y, 2C, 2M, and 2BK to form toner images of different colors, respectively. The toner images of different colors are formed on the image support bodies, respectively, and transferred superimposingly onto the intermediate transfer belt 3. The intermediate transfer belt 3 is an example of transfer means on which the toner images formed on the image support bodies are transferred. In FIG. 2, the number 1 represents the image formation apparatus body.

The toner images are formed on the image support bodies 2Y to 2BK of the first to fourth process cartridges 7Y to 7BK, respectively. The toner images are transferred onto the intermediate transfer belt in a substantially same manner except for the colors of the toner images. Therefore, a description will be made in the following only on an example where a toner image is formed on the image support body 2Y of the first process cartridge 7Y and transferred onto the intermediate transfer belt 3.

Figure 3:
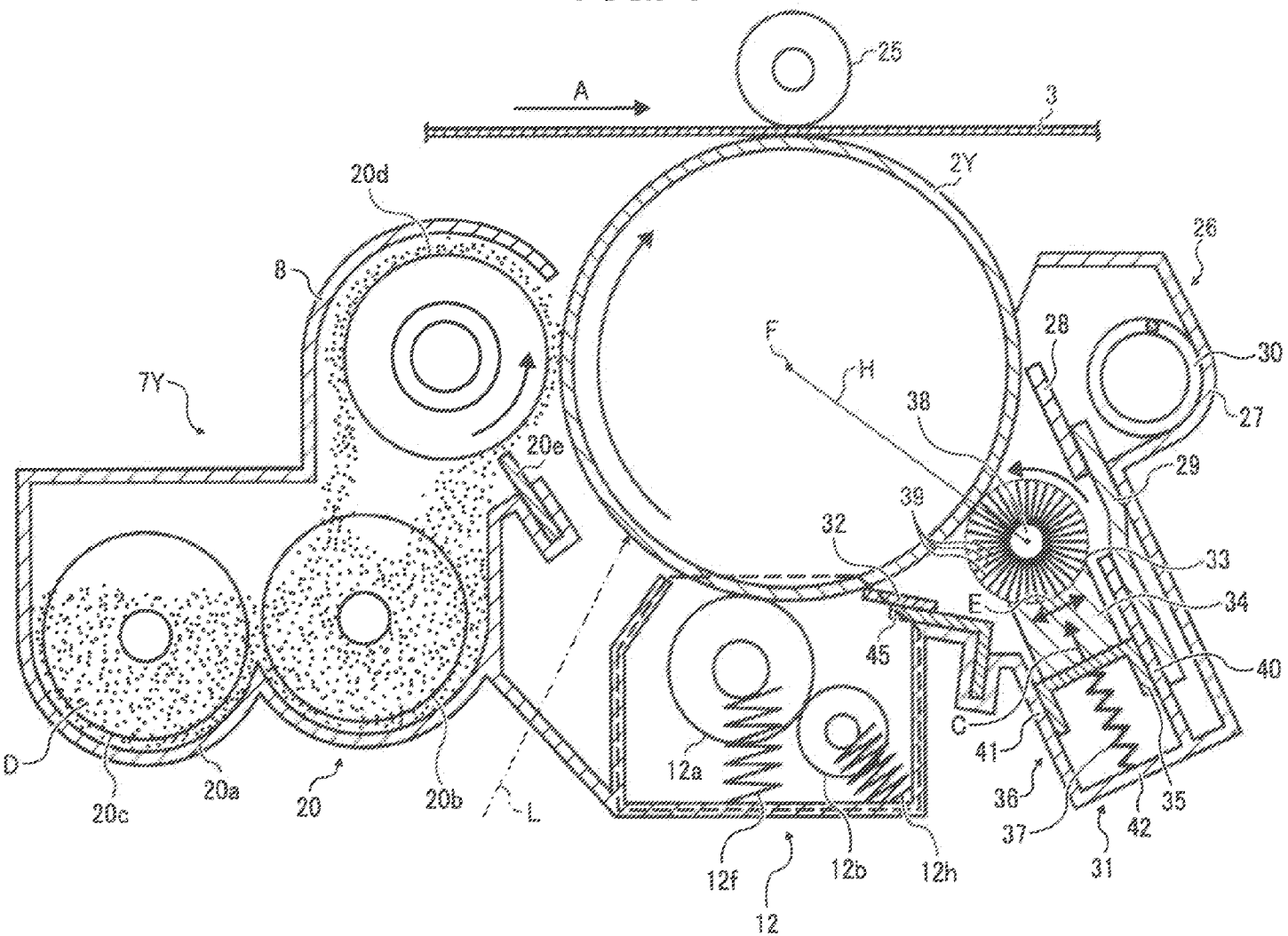
FIG. 3 is an enlarged view of a process cartridge shown in FIG. 2.
Figure 4:
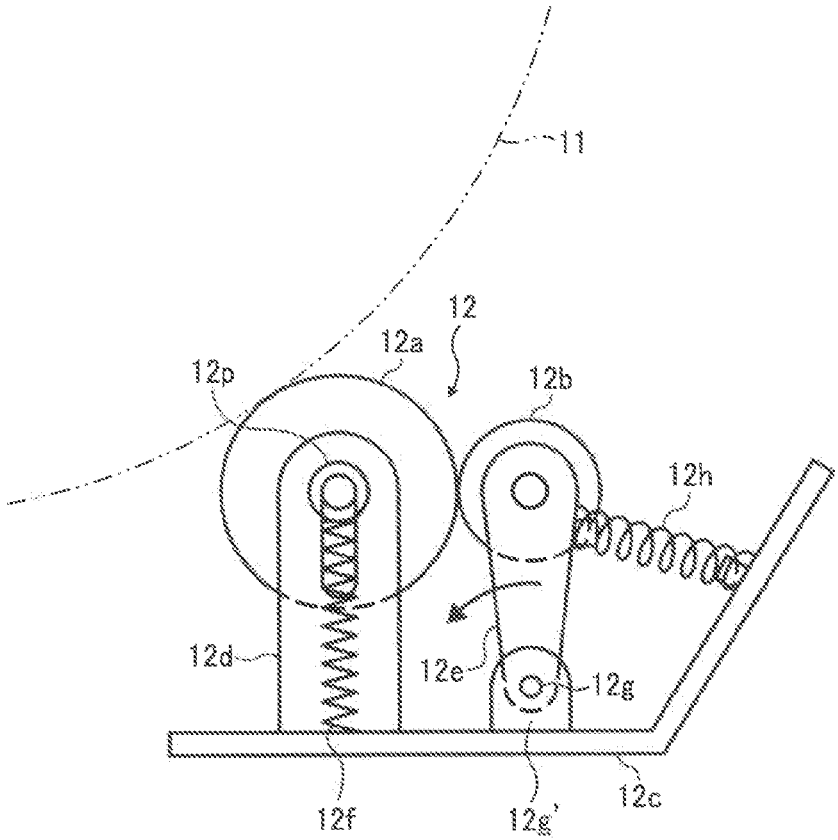
FIG. 4 shows a brief overview of the charge assembly according to an embodiment of the present invention.

FIG. 3 is an enlarged cross-section view of the first process cartridge 7Y. The image support body 2Y of the process cartridge 7Y is rotatably supported by a unit case 8. The image support body 2Y is rotationally driven by a not-shown driver device clockwise. A charge roller 12*a* is rotatably supported by the unit case 8, and applied with a charge voltage. The surface of the image support body 2Y is charged with a predetermined polarity by the charge roller 12*a*. After being charged, the image support body 2Y is irradiated with an optical modulation laser beam L from an optical write device 10 which is separate from the image support body 2Y as shown in FIG. 2. Thereby, an electrostatic latent image is formed on the image support body 2Y. The electrostatic latent image has a yellow toner attached thereto by a developing device 20 to be described below, and is visualized as a yellow toner image.

The developing device 20 has a developer case 20*a* constituted of a part of the unit case 8. The developer case 20*a* contains a two-component dry developer D having a toner and a carrier. It is also provided with two screws 20*b* and 20*c* which agitate the developer D, and a developing roller 20*d* which is rotationally driven counterclockwise.

The developer D is pumped up and supported on the circumferential surface of the developing roller 20*d*, and conveyed in a rotational direction of the developing roller 20*d*. Then, it passes through a doctor blade 20*e* and is conveyed to a develop area between the developing roller 20*d* and the image support body 2Y.

At this point, the toner in the developer D is transferred into the electrostatic latent image formed on the image support body 2Y by electrostatic action. Thereby, the electrostatic latent image is visualized as a toner image. The developer D having passed through the doctor blade 20*e* is separated from the developing roller 20*d* and agitated by the screws 20*b* and 20*c*. The toner image is formed on the image support body 2Y in such a manner. Note that a developing device using a one-component developer with no carrier is also adoptable.

Further, a first transfer roller 25 is disposed across the intermediate transfer belt 3 from the process cartridge 7Y. The first transfer roller 25 is applied with a transfer voltage. The toner image on the image support body 2Y is primarily transferred due to the transfer voltage onto the intermediate transfer belt 3 rotationally driven in the arrow A direction.

After the transfer of the toner image, remnant toner on the image support body 2Y is removed by a cleaning device 26 which has a cleaning case 27 constituted of a part of the unit case 8, a cleaning blade 28 having an edge portion pressure-welded on the surface of image support body 2Y, a blade holder 29 holding the cleaning blade 28, and a toner convey screw 30 disposed in the cleaning case 27.

The cleaning blade 28 is disposed so as to face the image support body 2Y in a direction opposite to the rotational direction of the image support body 2Y. The cleaning blade 28 is made of an elastic body such as rubber, and the base end thereof is fixed to the blade holder 29 with an adhesive, for example. The edge portion of the cleaning blade 28 is welded with pressure on the surface of the image support body 2Y. Because of this, the remnant toner on the image support body 2Y is scraped and removed.

The removed toner is discharged outside the cleaning case 26 by the rotationally driven toner convey screw 30. As described above, the cleaning blade 28 cleans the image support body 2Y after the toner image is transferred to the transfer medium (intermediate transfer belt 3). In addition, the process cartridge 7Y is provided with a lubricant coating device 31 which coats a lubricant on the image support body 2Y, a smooth blade 32 as lubricant smooth means which smoothes the lubricant coated on the image support body 2Y. This configuration will be described later.

Likewise, a cyan toner image, a magenta toner image, and a black toner image are formed on the second to fourth image support bodies 2C, 2M, 2BK of FIG. 2, respectively. In the primary transfer, these toner images are superimposed in sequence on the transferred yellow toner image on the intermediate transfer belt. Thereby, a composite toner image is formed on the intermediate transfer belt 3.

Similarly to the first image support body 2Y, the remnant toners on the image support bodies are removed by the cleaning device 26.

In a base part of the image formation apparatus body 1, a paper cassette 14A containing the recording paper 17 and a paper feeder 16A having a paper roller 15A, for example, are disposed as shown in FIG. 2. A top of the recording paper is ejected toward a direction of the arrow B by rotation of the paper roller 15A.

A part of the intermediate transfer belt 3 is reeled up into the support roller. A secondary transfer roller 18A is disposed in opposition to the support roller 4A. The ejected recording paper 17 is carried between the support roller 4A and the secondary transfer roller at a predetermined timing by a pair of resist rollers 17A. A predetermined voltage is applied to the secondary transfer roller 18A. Thereby, the composite toner image on the intermediate transfer belt 3 is secondarily transferred onto the recording paper 17.

The recording paper 17 on which the composite toner image is secondarily transferred is further carried upward to pass through a fuser device 19A. Thereby, the toner image on the recording paper 17 is fused thereon by heat and pressure. Having passed through the fuser device 19A, the recording paper 17 is ejected to a paper feeder part 22A on a top part of the image formation apparatus body 1.

After the transfer of the toner image, the remnant toner on the intermediate transfer belt 3 is removed by the cleaning member 18'. A toner waste box 21' is for storing the toner removed by the cleaning member 18'.

The image formation apparatus includes the above-described lubricant coating device 31 which functions to suppress frictional wear-down of the cleaning blade 28 and the image support body 2Y shown in FIG. 3. Also, even with use of spherical toner particles with small diameter, the lubricant coating device 31 allows the cleaning blade 28 to maintain a high cleaning performance.

The lubricant coating device 31 is also provided in the process cartridges 7C, 7M, and 7BK. The configuration and operation thereof are the same. Accordingly, a description will be made only on the lubricant coating device 31 in the process cartridge 7Y of FIG. 3 in the following.

The lubricant coating device 31 includes a brush roller 33 (lubricant coating member) in contact with the surface of the image support body 2Y, a solid lubricant 34 disposed in opposition to the brush roller 33, a lubricant holder 35 fixedly supporting the solid lubricant 34, a guide 36 guiding the solid lubricant 34 via the lubricant holder 35, and a compressed coil spring 37 as pressure means.

The brush roller 33 has a core axis 38 and a great number of brush fibers 39 whose base ends are fixed to the core axis 38, and extends long along and in substantially parallel with the image support body 2Y. The brush roller 33 is rotatably supported at respective ends of the core axis 38 in their longitudinal direction by the unit case 8 via a not-shown bearing. During the operation of the image formation apparatus, the brush roller 33 is rotationally driven counterclockwise in FIG. 3.

The solid lubricant 34 is formed in a rectangular solid shape, extending long in parallel with the brush roller 33. The front end of the brush roller 33 is in contact with the brush fiber 39, and the base end thereof is fixed to the lubricant holder 35.

The guide 36 has a pair of guide plates 40 and 41 which are integrated by a connecting plate 42. The pair of guide plates 40 and 41 and the connecting plate 42 are constituted of a part of the unit case 8.

The lubricant holder 35 is disposed between the pair of guide plates 40 and 41, and slidably abuts with opposed planes of the guide plates 40 and 41.

The solid lubricant 34 is pressurized to the brush roller 33 by use of the compressed coil spring 37, for example. The solid lubricant 34 is pressurized to get in contact with the brush roller 33 via the lubricant holder 35. FIG. 3 shows a direction of the pressurization by the arrow C. Springs such as torsion coil spring or blade spring can be also used in replace of the compressed coil spring 37.

The brush fiber 39 is pressurized to the surface of the image support body 2Y while the solid lubricant 34 is pressurized to the brush fiber 39 of the brush roller 33. The solid lubricant 34 is scraped off by the brush fiber 39 due to the rotation of the brush roller 33. Then, the scraped-off powdery lubricant is coated on the surface of the image support body 2Y.

As described above, the brush roller 33 functions as the lubricant coating member to apply the powdery lubricant scraped off from the solid lubricant 34 on the surface of the image support body 2Y.

The solid lubricant 34 is consumed by the scrape-off of the brush roller 33, and the thickness thereof decreases over time. However, since it is pressurized by the compressed coil spring 37, it is always made in contact with the brush fiber 39 of the brush roller 33.

A friction coefficient of the surface of the image support body 2Y can be maintained to be low owing to the lubricant coated thereon. This makes it possible to suppress the frictional wear-down of the image support body 2Y and the cleaning blade 28, which accordingly elongates longevity of the image support body 2Y and the cleaning blade 28.

Besides, even with the use of spherical toner particles of small diameter to be described later, it is possible to prevent the cleaning performance of the cleaning blade 28 on the image support body 2Y from greatly deteriorating.

Moreover, the lubricant coating device 31 is provided with the above-described guide 36 which guides the lubricant holder 35 and the solid lubricant 34 so that they are moved in such a direction to substantially get close to or get away from the brush roller 33, that is, an opposite direction to the direction of the pressurization by the compressed coil spring 37.

This can prevent the solid lubricant 34 from greatly swing in a direction E orthogonal to the direction C. Thus, the solid lubricant 34 can always make contact with the brush roller 33 at its substantially same area. In other words, a substantially constant amount of the solid lubricant is always applied with the surface of the image support body 2Y via the brush roller 33. This can prevents unevenness of the lubricant coating thereon.

The image formation apparatus above is configured such that the lubricant holder 35 abuts with the pair of the guide plates 40 and 41 to guide the solid lubricant 34 by the guide 36 via the lubricant holder 35. However, it can be also configured such that the solid lubricant 34 is directly guided by the guide 36.

Also, the solid lubricant 34 has only to be movable in the direction to substantially get close to or get away from the brush roller 33. That is, it can be configured to move in the direction E by only a margin.

Next, the smooth blade (lubricant smoothing means) 32 provided in the image formation apparatus will be described. The smooth blade 32 is made of an elastic body such as a rubber. The edge portion of the smooth blade 32 abuts with the surface of the image support body 2Y, and fixed to the holder 45 at its base end.

The smooth blade 32 is disposed in a trailing direction (the same direction as the moving direction) relative to the moving (rotation) direction of the surface of the image support body 2Y. The brush roller 33 as the lubricant coating member is disposed forward in the rotational direction of the image support body 2Y relative to the cleaning blade 28 as shown in FIG. 3.

After the transfer of the toner image, the remnant toner on the surface of the image support body 2Y is removed by the cleaning blade 28, and then the lubricant is coated on the clean surface thereof by the brush roller 33. The coated lubricant is evenly smoothed over the surface of image support body 2Y when passing through the smooth blade 32 abutting with the surface of the image support body 2Y. Accordingly, a lubricant layer with even thickness can be formed on the surface of the image support body 2Y.

As described above, coating the lubricant on the image support body 2Y immediately after cleaning it and evenly smoothing the lubricant makes it possible to prevent unevenness of the amount of coated lubricant on the surface of the image support body 2Y and deviation in the friction coefficient thereof. As a result, it is possible to improve the quality of images formed on a recording medium.

Besides, since the smooth blade 32 is disposed to face in the same direction as the moving direction of the surface of the image support body 2Y, it is able to prevent an excessive increase in a drive torque of the image support body 2Y.

Further, with regard to the brush fibers 39 of the brush roller 33 in the lubricant coating device 31, it is preferable that the thickness thereof should be 3 to 8 denier, and the density thereof should be 20,000 to 100,000 per inch. This is because too thin brush fibers easily fall down when getting in contact with the surface of the image support body while in contrast; too thick brush fibers cannot be arranged with a high density. Moreover, with a too low density of the brush fibers, the number of fibers in contact with the surface of the image support body is reduced, making it impossible to coat the lubricant thereon evenly. In contrast, with a too high density, a gap between the brush fibers is reduced, so that the brush fibers cannot scrape off sufficient amount of the powdery particles of the lubricant to coat on the surface sufficiently.

As for the solid lubricant 34, a dry solid hydrophobic lubricant can be used. In addition to zinc stearate, usable materials are, for example, materials containing a stearate group such as barium stearate, lead stearate, iron stearate, nickel stearate, cobalt stearate, copper stearate, strontium stearate, calcium stearate, cadmium stearate, magnesium stearate, or aliphatic acids such as zinc oleate, manganese oleate, oleic iron, oleic iron, oleic lead, magnesium oleate, oleic copper, palmitate, zinc palmitate cobalt, copper palmitate, magnesium palmitate, aluminum palmitate, or calcium palmitate. In addition, aliphatic acids such as lead caplyrate, lead caproate, zinc linolenate, cobalt linolenate, calcium linolenate, cadmium lycolinolenate, and waxes such as candelilla wax, carnauba wax, rice wax, tree wax, basil oil, beewax, or lanoline can be used.

Further, the toner used in the developing device 20 has preferably the volume mean particle diameter of 10μ or less, and a ratio Dv/Dn of the volume mean particle diameter Dv and the number mean particle diameter Dn (dispersion) of 1.00 to 1.40. Particularly, the toner preferably has the volume mean particle diameter 3 to 8 μm since the toner with a small particle diameter can be attached very densely on the electrostatic latent image.

However, when a toner with too low volume mean particle diameter is used for the two-component developer, the toner is fusion-bonded on the surface of a magnetic carrier by a long time agitation in the developing device, causing a decrease in chargeability of the magnetic carrier. With use of one-component developer, toner filming to the developing roller and fusion-bonding of the toner on the cleaning blade are likely to occur.

On the other hand, with use of a toner with too large volume mean particle diameter, it is difficult to obtain images with high resolution and high quality. Also, the particle diameter of the toner greatly fluctuates in many cases when the toner is balanced in the developer.

Moreover, narrowing a distribution in the particle diameter of the toner makes uniform charge distribution in the toner. This can result in attaining high-quality images with less background fogging and improving a transfer rate. However, the ratio Dv/Dn over 1.40 is not preferable since it causes a wide charge distribution and a decrease in the resolution.

Note that the mean particle diameter and particle distribution of the toner can be measured by a Coulter counter TA-II or a Coulter multisizer II (both manufactured by Beckman Coulter, Inc.). Here, they have been measured by the Coulter counter TA-II connected to an interface (manufactured by The Institute of Japanese Union of Scientists & Engineers) and a personal computer (PC9801, manufactured by NEC Corporation) for outputting a number distribution and a volume distribution.

Along with the reduction of the particle diameter of the toner, the amount of internal or external additives such as a wax for improving releasability and an inorganic particulate for improving fluidity are proportionally increased in the toner. These additives are the causes of the attachments on the image support body.

According to the present embodiment, it is able to form a thin uniform layer of the lubricant on the entire surface of the image support body 2Y owing to the provision of the lubricant coating device 31. This can accordingly reduce adhesion of the attachments on the image support body 2Y, and also reduce the friction between the surface of the image support body 2Y, the cleaning device 26, and the smooth blade 32 to achieve good cleaning performance.

In terms of degree of circularity of the toner, a coating effect of the lubricant on the image support body is significant when the toner with the mean circularity of 0.93 to 1.00 is used. This is because coating the lubricant on the image support body makes it possible to effectively prevent a problem that the toner with high circularity goes through the cleaning blade 28 without touching it.

The mean circularity of the toner is obtained by optically detecting a particle, obtaining a projected area thereof and dividing the projected area by a circumferential length of a circle of the equivalent projected area to that of the detected particle. Specifically, it is measured by use of a flow-type particle image analyzer (FPIA-2000, manufactured by Sysmex Corporation) as follows. First, solid impurities are removed from water of 100 to 150 mL in advance, and the water is put into a predetermined container, and a surfactant agent of 0.1 mL to 0.5 mL as a dispersant and a sample of about 0.1 to 9.5 g are added thereto to obtain a suspension fluid in which the sample is dispersed. The suspension fluid is dispersed by an ultrasonic disperser for about one to three minutes. The shape and distribution of the toner is measured by use of the dispersed fluid in concentration of 3,000 to 10,000 piece/μL.

Further, the toner used in the developing device 20 is of a shape coefficient SF-1 of 100 to 180 and a shape coefficient SF-2 of 100 to 180. The shape coefficient SF-1 signifies a degree of roundness of a toner's shape, and when the shape coefficient SF-1 is 100, the toner's shape will be a perfect sphere. The larger the SF-1 is, the more unshaped the shape is. The shape coefficient SF-2 signifies a ratio of concavity and convexity. There is no unevenness on the surface of the toner when the shape coefficient SF-2 is 100. The larger the SF-2 is, the more obvious the unevenness is. Japanese Patent Application Laid-Open Publication No. 2002-244484 may be referred to on this matter.

When the shape of the toner is almost spherical, toner particles and toner particles or the toner and the image support body make point contact with each other. This weakens absorptivity between the toner particles and increases the fluidity thereof accordingly. It also weakens the absorptivity between the toner and the image support body and increases the transfer rate. Moreover, the spherical toner can easily slide into the gaps of the cleaning blade 28 and the image support body. Therefore, it can be said that the shape coefficients SF-1 and SF-2 of the toner should be large to some degree. However, large coefficients SF-1 and SF-2 cause a dispersion of the toner on the image, thereby deteriorating the image quality, so that the shape coefficient Sf-1 and SF-2 should not exceed 180 preferably. Note that according to the present embodiment, the shape coefficients are measured, specifically, by taking a picture of the toner by a scanning electron microscope (S-800, manufactured by Hitachi Limited) and inputting data on the picture to an image analysis device (S-800, manufactured by Nireco Corporation) for analytical computation.

Further, the toner used in the image formation apparatus according to the present embodiment is fabricated in the following manner. For example, at least polyester-prepolymer having a functional group including nitrogen atom, polyester, colorant, and release agent are dispersed in an organic solvent to make a toner solution as a toner composition. Then, the toner solution is subjected to cross-link reaction and elongation reaction in an aqueous solvent under the presence of resin microparticles. Hereinafter, the components and the fabrication method of the toner will be described referring to examples.

(Modified Polyester)

The toner contains modified polyester (i) as a binder resin. Here, the modified polyester (i) signifies a polyester resin containing a bonding group other than ester bond or a polyester resin covalently-bonded or ionically-bonded with a different resin component. Specifically, it is obtained by modifying a polyester terminal by introducing thereinto a functional group such as an isocyanate group reactive to a carboxylic acid group, a hydroxyl group to react the resultant with an active hydrogen containing compound.

The modified polyester (i) is, for example, urea-modified polyester obtained by reacting isocyanate group-containing polyester prepolymer (A) with amines (B). The isocyanate group-containing polyester prepolymer (A) is exemplified by one as polycondensation product of polyol (PO) and polycarboxylic acid and containing an active hydrogen group reacted with a polyisocyanate compound (PIC).

The active hydrogen group in this polyester is exemplified by a hydroxyl group (alcoholic hydroxyl group and phenolic hydroxyl group), an amino group, a carboxyl group, a mercapto group or the like. Among these groups, the alcoholic hydroxyl group is preferable. The urea-modified polyester is produced as follows.

Polyols (PO) include diol (DIO) and polyols three or more hydroxyl groups (TO). It is preferable to use (DIO) alone, or a mixture of (DIO) and a small amount of (TO). Diols (DIO) include alkylene glycols (ethylene glycol, 1,2-propylene glycol, 1,3-propylene glycol, 1,4-butane diol, 1,6-hexane diol, etc.); alkylene ether glycols (diethylene glycol, triethylene glycol, dipropylene glycol, polyethylene glycol, polypropylene glycol polytetramethylene ether glycol, etc.); alicyclic diols (1,4-cyclohexane dimethanol, hydrogenated bisphenol A, etc.); bisphenols (bisphenol A, bisphenol F, bisphenol S, etc.); adducts of the aforementioned alicyclic diols with alkylene oxides (ethylene oxide, propylene oxide, butylene oxide, etc.); adducts of the aforementioned bisphenols with alkylene oxides (ethylene oxide, propylene oxide, butylene oxide, etc.); etc. Among these, alkylene glycols having 2 to 12 carbon atoms and adducts of bisphenols with alkylene oxides are preferred, and particularly preferred are adducts of bisphenols with alkylene oxides and a mixture thereof with alkylene glycols having 2 to 12 carbon atoms. Polyols having three or more hydroxyl groups (TO) include polyhydric aliphatic alcohols having 3 to 8 or more hydroxyl groups (glycerin, trimethylolethane, trimethylolpropane, pentaerythritol, sorbitol, etc.); phenols having 3 or more hydroxyl groups (trisphenol PA, phenol novolac, cresol novolac, etc.); adducts of the aforementioned polyhydric phenols having 3 or more hydroxyl groups with alkylene oxides; etc.

Polycarboxylic acids (PC) include dicarboxylic acids (DIC), polycarboxylic acids having three or more hydroxyl groups (TC), etc. It is preferable to use (DIC) alone, or a mixture of (DIC) and a small amount of (TC). Dicarboxylic acids (DIC) include alkylene dicarboxylic acids (succinic acid, adipic acid, sebacic acid, etc.); alkenylene dicarboxylic acids (maleic acid, fumaric acid, etc.); aromatic dicarboxylic acids (phthalic acid, isophthalic acid, terephthalic acid, naphthalene dicarboxylic acid, etc.); etc. Among these, alkenylene dicarboxylic acids having 4 to 20 carbon atoms and aromatic dicarboxylic acids having 8 to 20 carbon atoms are preferable. Polycarboxylic acids having three or more hydroxyl groups (TC) include aromatic polycarboxylic acids having 9 to 20 carbon atoms (trimellitic acid, pyromellitic acid, etc.). Note that polycarboxylic acids (PC) may be replaced with an acid anhydride or a lower alkyl ester (methyl ester, ethyl ester, isopropyl ester, or the like) of the above-described carboxylic acids to be reacted with polyols (PO).

The ratio of a polyol (PO) to a polycarboxylic acid (PC), by the equivalent ratio of hydroxyl groups (OH) to carboxyl groups (COOH), [OH]/[COOH], is typically 2/1 to 1/1, preferably 1.5/1 to 1/1, more preferably 1.3/1 to 1.02/1.

Polyisocyanates (PIC) include aliphatic polyisocyanates (tetramethylene diisocyanate, hexamethylene diisocyanate, 2,6-diisocyanate methylcaproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromaticaliphaticdiisocyanates ($\alpha,\alpha,\alpha',\alpha'$,-tetramethylxylene diisocyanate etc.); isocyanates; above-mentioned polyisocyanates blocked with a phenol derivative, an oxime, caprolactum, or the like; and combinations of two or more of these.

The ratio of a polyisocyanate (PIC), by the equivalent ratio of isocyanate groups (NCO) to hydroxyl groups (OH) of the polyester, [NCO]/[OH], is typically 5/1 to 1/1, preferably 4/1 to 1.2/1, more preferably 2.5/1 to 1.5/1. When the ratio [NCO]/[OH] is more than 5, low-temperature fusibility is degraded. When the molar ratio of [NCO] is less than 1, the amount of urea in the modified polyester is low, thus deteriorating hot offset resistance.

The amount of polyisocyanate (PIC) component in an isocyanate group-containing polyester prepolymer (A) (containing at an end) is typically 0.5% to 40% of part weight, preferably 1% to 30% of part weight, more preferably 2% to 20% of part weight. If the amount is less than 0.5% of part weight, hot offset resistance is lowered and it is disadvantageous that heat-resistance during storage and low-temperature fusibility cannot be achieved at the same time. If the amount is more than 40% of part weight, low-temperature fusibility is degraded.

The number of isocyanate groups contained in each molecule of isocyanate group-containing polyester prepolymer (A) is typically one or more, preferably 1.5 to 3 on average, more preferably 1.8 to 2.5 on average. If it is less than one per molecule, the molecular weight of the urea modified polyester is reduced, and hot offset resistance is degraded.

Next, amines (B) to be reacted with polyester prepolymers (A) include diamines (B1), polyamines having 3 or more amino groups (B2), amino alcohols (B3), amino mercaptans (B4), amino acids (B5), derivatives of B1 to B5 in which the amino groups are blocked (B6), etc.

Diamines (B1) include aromatic diamines (phenylene diamine, diethyltoluene diamine, 4,4'-diaminodiphenylmethane, etc.); alicyclic diamines (4,4'-diamino-3,3'-dimethyldicyclohexylmethane, diaminocyclohexane, isophoronediamine, etc.); aliphatic diamines (ethylenediamine, tetramethylenediamine, hexamethylenediamine, etc.); etc. Polyamines having three or more amino groups (B2) include diethylenetriamine, triethylenetetramine, etc. Amino alcohols (B3) include ethanolamine, hydroxyethylaniline, etc. Amino mercaptans (B4) include aminoethyl mercaptan, aminopropyl mercaptan, etc. Amino acids (B5) include amino propionic acid, aminocaproic acid, etc. The aforementioned derivatives of B1 to B5 in which the amino groups are blocked (B6) include ketimine compounds that are obtained from amines of B1 to B5 and ketones (acetone, methylethylketone, methylisobutylketone, etc.), and oxazolidine compounds, etc. Among these amines (B), B1 and a mixture of B1 and a small amount of B2 are preferable.

The ratio of amines (B) by the equivalent ratio of isocyanate groups [NCO] in the isocyanate group-containing polyester prepolymer (A) to amino groups [NHx] in the amine (B), which is [NCO]/[NHx], is typically 1/2 to 2/1, preferably 1.5/1 to 1/1.5, more preferably 1.2/1 to 1/1.2. If the ratio [NCO]/[NHx] is over 2 or less than 1/2, the molecular weight of the urea modified polyester will be low and its hot offset resistance will be degraded.

Moreover, the urea modified polyester may contain urethane bonds and urea bonds. The mol ratio of the urea bond content to the urethane bond content is normally 100/0 to 10/90, preferably 80/20 to 20/80, and most preferably, 60/40 to 30/70. If the urea bond mol ratio is less than 10%, the hot offset resistance will be degraded.

The modified polyester (i) used in the present embodiment is produced by a one shot method or a prepolymer method. The weight average molecular weight of the modified polyester (i) is typically 10,000 or more, preferably from 20,000 to 10,000,000, and most preferably from 30,000 to 1,000,000. The peak molecular weight here is preferably from 1,000 to 10,000, and when it is less than 1,000, the elongation reaction does not easily occur, the toner has little elasticity, and the result is degradation of the hot offset resistance. To the contrary, when it is over 10,000, manufacturing problems occur such as decrease in fusibility, particularization and crushing. The number average particle weight of the modified polyester (i) is not particularly limited when the unmodified polyester (ii) described later is used, and it may be one easily obtained as the aforementioned weight average molecular weight. When used alone, the number average molecular weight of (i) is normally 20,000 or less, preferably from 1,000 to 10,000, and most preferably from 2,000 to 8,000. When over 20,000, the low temperature fusibility and luster when used in full-color devices deteriorate.

It is possible to obtain the modified polyester (i) by using a reaction inhibitor as necessary through the elongation or cross-linking reaction between the polyester prepolymer (A) and the amines (B) and to adjust the molecular weight of the urea modified polyester obtained. The reaction inhibitor is for example Monoamine (diethylamine, dibutylamine, butylamine, laurylamine, etc.) blocked monoamines (ketimine compounds), etc. Further, the molecular weights of the polymers synthesized can be measured by gel permeation chromatography (GPC) using THF as the solvent.

(Unmodified Polyester)

According to the present embodiment, the aforementioned modified polyester (i) can be used alone, or it can contain the unmodified polyester (ii) as a binder resin component. Co-use with (ii) is preferable to independent use since it improves low-temperature fusibility and the luster when used in a full-color device. Examples of (ii) include the same polyester components of (i) above, which are condensation polymerization products of polyols (PO) and polycarboxylic acids (PC), and preferred examples are also the same as those of (i). In addition to an unmodified polyester, (ii) can also be a polyester modified by a chemical bond other than a urea bond, for example, a urethane bond. It is preferable in terms of the low-temperature fusibility and hot offset resistance that (i) and (ii) form a mixture that is compatible at least in a portion thereof. Therefore, it is preferred that the polyester components of (i) and (ii) have similar compositions. When (i) contains (ii), the weight ratio of (i) to (ii) is typically 5/95 to 80/20, preferably 5/95 to 30/70, more preferably 5/95 to 25/75, and most preferably 7/93 to 20/80. When the weight ratio of (i) is less than 5%, hot offset resistance is degraded, and it is disadvantageous that heat-resistance during storage and low-temperature fusibility cannot be satisfied simultaneously.

The peak molecular weight of (ii) is typically from 1,000 to 10,000, preferably from 2,000 to 8,000, more preferably from 2,000 to 5,000. When it is lower than 1,000, heat-resistance during storage is degraded, and when it is higher than 10,000, low-temperature fusibility is degraded. The hydroxyl value of (ii) is preferably five or more, more preferably 10 to 120, and most preferably 20 to 80. When it is less than five, it is disadvantageous that heat-resistance during storage and low-temperature fusibility cannot be simultaneously satisfied. The acid value of (ii) is typically one to five, preferably two to four. With use of high acid wax, a low acid binder is suitable since it achieves good chargeability and high volume resistance, and easily matches with a toner used in a two-component developer.

The glass transition temperature (Tg) of the binder resins is typically from 35 to 70° C., preferably 55 to 65° C. When it is lower than 35° C., the heat-resistance during storage of the toner is degraded, and when higher than 70° C., sufficient low-temperature fusibility cannot be attained. Because urea modified polyesters are prone to stay on the surface of the toner base particles obtained, the toner according to the present embodiment exhibits better heat-resistance during storage than well-known polyester toners, even with the binder resin of a low glass transition temperature. The glass transition temperature (Tg) can be measured by a differential scanning calorimeter (DSC).

(Colorant)

All of known dyes and pigments are used for the colorants. The examples include carbon black, nigrosine dyes, iron black, Naphthol Yellow S, Hansa Yellow (10G, 5G and G), cadmium yellow, yellow iron oxide, yellow ocher, chrome yellow, titanium yellow, polyazo yellow, oil yellow, Hansa Yellow (GR, A, RN and R), Pigment Yellow L, Benzidine Yellow (G and GR), Permanent Yellow (NCG), Vulcan Fast Yellow (5G and R), tartrazine lake, quinoline yellow lake, Anthrazane Yellow BGL, and iso-indolinone yellow, colcothar, red lead, vermilion lead, cadmium red, cadmium-mercury red, antimony red, Permanent Red 4R, para-nitraniline red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red (F5R), Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rodamine Lake B, Rodamine Lake Y, alizarin lake, Thioindigo Red B, Thioindigo Maroon, oil red, quinacridon red, pyrazolone red, polyazo red, chromium vermilion, benzidine orange, perinone orange and oil orange, cobalt blue, Cerulean Blue, alkali blue lake, peacock blue lake, Victoria Blue Lake, metal-free phthalocyanine blue, phthalocyanine blue, Fast Sky-Blue, Indanthrene Blue (RS and BC), indigo, Prussian Blue, ultramarine blue, anthraquinone blue, Fast Violet B, methyl violet lake, cobalt violet, manganese violet, dioxane violet, anthraquinone violet, chromium green, zinc green, chromium oxide, Viridian, emerald green, Pigment Green B, Naphthol Green B, green gold, acid green lake, Malachite Green Lake, phthalocyanine green and anthraquinone green, titania oxide, zinc oxide, lithopone, etc. These colorants can be used alone or in combination, and the contents of the colorants relative to the toner is generally 1-15% of part weight, preferably 3-10% of part weight.

These colorants can be combined with resins and used for a master batch. Binder resins used for manufacture of a master batch or being mixed with a master batch include, for example, polymers of styrene or substituted styrenes such as polystyrene, poly p-chlorostyrene, polyvinyl toluene, etc., or copolymers thereof with vinyl compound; polymethylmethacrylate, polybutylmethacrylate, polyvinyl chloride, polyvinyl acetate, polyethylene, polypropylene, polyester, epoxy resins, epoxy polyol resins, polyurethanes, polyamides, polyvinyl butyral, polyacrylic resins, rosin, modified rosin, terpene resin, aliphatic or alicyclic hydrocarbon resins, aromatic petroleum resins, chlorinated paraffin, paraffin wax, etc. These may be used either alone or in combination.

(Charge Control Agent)

Any well-known charge control agent may be used, for example, negrosine dyes, triphenylmethane dyes, chrome-containing metal complex dyes, molybdic acid chelate dyes, rhodamine dyes, alkoxy amines, quaternary ammonium salts (including fluorinated quaternary ammonium salts), alkyl amides, phosphorus and its compounds, tungsten and its compounds, fluorine activating agents, metal salicilates, metal salts of salicylic acid derivatives, etc. Specific examples are Bontron 03 as the negrosine dye, Bontron P-51 as the quaternary ammonium salt, Bontron S-34 as the alloy metal azo dye, oxynaphthoic acid metal complex E-82, the salicylic acid metal complex E-84, the phenolic condensate E-89 (manufactured by Orient Chemical Industries), the quaternary ammonium salt molybdenum complexes TP-302, TP-415 (manufactured by Hodogaya Chemical Industries), the quaternary ammonium salt Copy Charge PSY VP2038, the triphenylmethane derivative Copy Blue PR, the quaternary ammonium salts Copy Charge NEG VP2036 and Copy Charge NX VP434 (manufactured by Hoechst), LRA-901, LR-147 as the boron complex (manufactured by Japan Carlit Co., Ltd.), copper phthalocyanine, perylene, quinacridone, azo pigments, and other polymer compounds containing a functional groups such as sulfonic acid group, carboxyl group, quaternary ammonium salt, etc. Of these, substances that control the toner by negative polarity are particularly preferable.

The amount of the charge control agent is determined according to a type of the binder resin, the presence or absence of additives used if necessary, and toner manufacturing method including dispersion method. It is not primarily limited to a certain amount; however, a preferable range thereof should be 0.1 to 10 weight parts relative to 100 weight parts of the binder resin, and more preferably, 0.2 to 5 weight parts. The use of over 10 weight parts of the charge control agent makes the chargeability of the toner too large, causing an increase in electrostatic absorption between the toner and the developing roller, a reduction in the fluidity of the developer, and a reduction in the density of the image.

(Releasing Agents)

For the releasing agent, waxes with a melting point of 50 to 120° C. are preferable, since they effectively work as the releasing agent between the fuser roller and the interface of the toner during dispersion from the binder resin and achieve an anti-offset effect at high temperature without coating the releasing agent such as oil on the fuser roller. The examples of such waxes are as follows.

Waxes are exemplified by vegetable waxes such as carnauba wax, cotton wax, tree wax, and rice wax; animal wax such as beeswax and lanolin; mineral wax such as ozokerite and ceresin; and petroleum wax such as paraffin, microcrystalline, and petrolatum. In addition to these natural waxes, there are synthetic hydrocarbon waxes such as Fischer Tropsch wax and polyethylene wax; and synthetic waxes such as esters, ketones, and ethers. Other examples are fatty acid amides such as 12-hydroxystearic acid amide, stearic acid amide, anhydrous phthalic acid amide, and chlorinated hydrocarbon; and crystalline polymers having a long-chained alkyl group, which are crystalline polymer resins of low molecular weight, and homopolymers or copolymers (for example, n-stearyl acrylate-ethyl methacrylate copolymer, etc.) of polyacrylates such as poly-n-stearyl methacrylate and poly-n-lauryl methacrylate.

The charge control agent and release agent can be melted and kneaded with the master batch and binder resin, or added to the organic solvent at the fusion and dispersion.

(External Additives)

Inorganic microparticles are preferably used for the external additives to support the fluidity, developing performance, and chargeability of the toner particles. The primary particle diameter should be preferably 5×10−3 to 2 μm, more preferably 5×10−3 to 0.5 μm. Specific surface area according to BET method should be preferably 20 to 500 m/g. The ratio of the inorganic microparticles to the toner should be preferably 0.01 to 5 wt %, more preferably 0.01 to 2.0 wt %.

Examples of inorganic particulates include silica, alumina, titanium oxide, barium titanate, magnesium titanate, calcium titanate, strontium titanate, zinc oxide, tin oxide, silica sand, clay, mica, silicic pyroclastic rock, diatomite, chromium oxide, cerium oxide, red iron oxide, antimony trioxide, magnesium oxide, zirconium oxide, barium sulfate, barium carbonate, calcium carbonate, silicon carbide, silicon nitride, etc. Among them, preferably, hydrophobic silica microparticles and hydrophobic titanium oxide microparticles are combined for fluid additives. Specifically, both of the particulates with mean particle diameter of 5×10−2 μm or less are used in agitated mixture in the developing device to obtain a desired charge level, electrostatic performance and van der Waals binding to the toner are tremendously improved. Therefore, it is made possible to attain images with good image quality without flaring and reduce the amount of the remnant toner after the transfer.

The titanium oxide microparticles have good qualities in terms of environmental stability and stable image density; however, they tend to deteriorate a charge rising characteristic. Therefore, when the titanium oxide microparticles are added to the toner with a larger amount than the silica particulate, such deterioration effect will be considerable. However, maintaining the additive amount of the titanium oxide microparticles in a range of 0.3 to 1.5 wt % makes it possible to obtain a desirable charge rising characteristic, whereby images with good stable quality can be obtained even at the time of repetitive copying, for example.

Next, the toner manufacturing method will be explained. Herein, a description will be made on preferable methods as examples; however, the method should not be limited thereto.

(Toner Manufacturing Method)

(1) Toner solution is prepared by dispersing colorants, unmodified polyester, isocyanate group-containing polyester prepolymer, and a releasing agent in an organic solvent.

Preferable organic solvents should be volatile with a boiling point of less than 100° C. since they are easily removed after the toner base particles are formed. Specifically, the examples are toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone, methyl isobutyl ketone, etc., and they can be used alone or in combinations of two or more kinds. Particularly, aromatic solvents such as toluene and xylene, and halogenated hydrocarbons such as methylene chloride, 1,2-dichloroethane, chloroform, and carbon tetrachloride are preferable. The amount of the organic solvent to be used is typically 0 to 300 weight parts relative to 100 weight parts of polyester prepolymer, preferably 0 to 100 weight parts, and more preferably 25 to 70 weight parts.

(2) The toner solution is emulsified in an aqueous medium with a surfactant and resin microparticles. The aqueous medium can be water alone or water containing an organic solvent such as alcohol (methanol, isopropyl alcohol, ethylene glycol, etc.), dimethylformamide, tetrahydrofuran, cellusolves (methyl cellusolve, etc.), and lower ketones (acetone, methyl ethyl ketone, etc.).

The amount of the aqueous medium to be used relative to 100 weight parts of toner solution is typically 50 to 2,000 weight parts, and preferably 100 to 1,000 weight parts. When the amount thereof is less than 50 weight parts, the toner solution cannot be dispersed enough to obtain toner particles of a predetermined particle diameter, while with that of over 20,000 weight parts, cost efficiency is not good. Also, to keep the dispersion in the aqueous medium in good condition, dispersion agents such as surfactant or resin are added thereto appropriately.

Examples of surfactants include anionic surfactants such as alkyl benzene sulfonates, α-olefin sulfonates, phosphoric acid esters, or the like; amine salts such as alkylamine salts, aminoalcohol fatty acid derivatives, polyamine fatty acid derivatives, imidazoline, or the like; quaternary ammonium salt cationic surfactants such as alkyltrimethyl ammonium salts, dialkyl dimethyl ammonium salts, alkyl dimethyl benzyl ammonium salts, pyridinium salts, alkyl isoquinolinium salts, benzetonium chloride, or the like; non-ionic surfactants such as fatty acid amide derivatives, polyvalent alcohol derivatives, or the like; amphoteric surfactants such as alanine, dodecyldi(aminoethyl)glycine, di(octylaminoethyl) glycine, N-alkyl-N,N-dimethylammoniumbetaine, etc.

Further, the use of a very small amount of a surfactant having a fluoroalkyl group can achieve a great effect. Examples of anionic surfactants having the fluoro alkyl group are preferably fluoroalkyl carboxylic acids having 2 to 10 carbon atoms and metal salts thereof, disodium perfluorooctane sulfonylglutamate, sodium 3-[ω-fluoroalkyl (C6 to C11) oxy]-1-alkyl (C3 to C4)sulfonate, sodium 3-[ω-fluoroalkanoyl (C6 to C8)-N-ethylamino]-1-propane sulfonate, fluoroalkyl (C11 to C20) carboxylic acids and metal salts thereof, perfluoroalkyl carboxylic acids (C7 to C13) and metal salts thereof, perfluoroalkyl (C4 to C12) sulfonates and metal salts thereof, perfluorooctanesulfonic acid diethanolamide, N-propyl-N-(2-hydroxyethyl) perfluorooctane sulfonamide, perfluoroalkyl (C6 to C10) sulfonamide propyltrimethylammonium salt, perfluoroalkyl (C6 to C10)-N-ethylsulfonyl glycine salt, monoperfluoroalkyl (C6 to C16) ethyl phosphoric acid ester, etc.

Available commercial products are, for example, Surflon S-111, S-112, S-113 (manufactured by Asahi Glass Co. Ltd), Fluorad FC-93, FC-95, FC-98, FC-129 (Sumitomo 3M Limited), Unidyne DS-101, DS-102 (Daikin Industries Ltd.), Megafack F-1110, F-120, F-113, F-191, F-812, F-833 (manufactured by Dainippon Ink And Chemicals, Incorporated), Ekutop EF-102 to 105, 112, 123A, 123B, 306A, 501, 201, 204 (manufactured by Tohkem Products Corporation), Ftergent F-100, F150 (manufactured by Neos Company Limited).

The examples of cationic surfactants are primary or secondary fatty series or secondary amine acids having a fluoroalkyl group, quaternary ammonium salts of fatty acids such as perfluoroalkyl (C6 to C10) sulfonamide propyltrimethylammonium salt, or the like; benzalkonium salts, benzetonium chloride, pyridinium chloride and imidazolinium salts. Available commercial products are, for example, Surflon S-121 (manufactured by Asahi Glass Co., Ltd.), Fluorad FC-135 (manufactured by Sumitomo 3M, Co., Ltd.). Unidyne DS-202 (manufactured by Daikin Industries, Ltd.), Megafack F-150 and F-824 (manufactured by Dainippon Ink and Chemicals Incorporated), Ekutop EF-132 (manufactured by Tochem Products Corporation), Ftergent F-300 (manufactured by NEOS Company Limited), etc.

Resin microparticles are added in order to stabilize the toner base particles that are formed in the aqueous medium. For this purpose, microparticles are added so as to have the covering rate on the surface of the toner base particles preferably in the range of 10 to 90%. They are, for example, polymethylmethacrylate micro particles 1 μm and 3 μm, polystyrene microparticles 0.5 μm and 2 μm, poly(styrene-acrylonitryl) microparticles 1 μm. Available commercial products are, for example, PB-200H (manufactured by Kao Corporation), SGP (manufactured by Soken Co. Ltd), technopolymer SB (manufactured by Sekisui Plastics O. Ltd), SGP-3G (manufactured by Soken Co. Ltd.), and Micropar (manufactured by Sekisui Fine Chemicals Co. Ltd.). Inorganic compound dispersion agents such as tricalcium phosphate, calcium carbonate, titanium oxide, colloidal silica, hydroxyapatite, or the like can be also used.

The dispersion agents usable with the aforementioned resin microparticles and inorganic compound dispersion agents are ones in which dispersion droplets are stabilized by a high polymer protecting colloid. Examples are acids such as acrylic acid, methacrylic acid, α-cyanoacrylic acid, α-cyanomethacrylic acid, itaconic acid, crotonic acid, fumaric acid, maleic acid, maleic anhydride, or the like; (meth) acrylic monomers which contain hydroxyl groups such as β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl acrylic acid, 3-chloro-2-hydroxypropyl methacrylic acid, diethylene glycol monoacrylic acid ester, diethylene glycol monomethacrylic acid ester, glycerine monoacrylic acid ester, glycerine monomethacrylic acid ester, N-methylolacrylamide, N-methylolmethacrylamide, or the like; vinyl alcohol or ether of vinyl alcohol such as vinyl methyl ether, vinyl ethyl ether and vinyl propyl ether, etc., esters of compounds containing a carboxylic group with vinyl alcohol such as vinyl acetate, vinyl propionate and vinyl butyrate, etc., acrylamide, methacrylamide, diacetone acrylamide, methylol compounds thereof, or the like; acid chlorides such as acrylic acid chloride and methacrylic acid chloride, homopolymers and copolymers containing a nitrogen compound or heterocyclic ring such as vinyl pyridine, vinyl pyrolidone, vinyl imidazole, ethyleneimine, or the like; polyoxyethylene compounds such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester, or the like; celluloses such as methyl cellulose, hydroxyethyl cellulose, hydroxypropyl cellulose, or the like, etc.

There is no particular limitation on the dispersion method which may employ any known dispersion apparatus using such as low speed shear, high speed shear, friction, high-pressure jet, ultrasound, or the like. Among them, the high speed shear dispersion apparatus is preferred to obtain dispersed particles having a diameter of 2 to 20 μm. With use of the high speed shear dispersion apparatus, rotation speed thereof is not particularly limited, however, it is typically 1,000 to 30,000 rpm, and preferably 5,000 to 20,000 rpm. Nor particularly limited is dispersion time thereof, however in the case of a batch process, it is typically 0.1 to 5 minutes. The temperature at the dispersion is typically 0 to 150° C. (under pressure), preferably 40 to 98° C.

(3) Concurrently with the preparation of the emulsifying solution, amines (B) are added, and reacted with the isocyanate base-containing polyester prepolymer (A). This reaction occurs in conjunction with molecular chain elongation and/or cross-linking. The reaction time may be determined according to the reactivity of the combination of the isocyanate group in the polyester prepolymer (A) and the amine (B), and it is typically 10 minutes to 40 hours, and is preferably 2 to 24 hours. The reaction temperature is typically 0 to 150° C., and preferably 40 to 98° C. A catalyst known in the art may also be used if required. Examples are dibutyl tin laurate, dioctyl tin laurate, etc.

(4) After completion of the reaction, toner base particles are obtained by removing the organic solvent from the emulsified dispersion (reaction product), rinsing, and drying. In order to remove the organic solvent, the temperature of the entire system is gradually raised while laminar agitation is conducted on the dispersion. When the temperature reaches in a fixed temperature range, strong agitation is conducted thereon. Thereafter, spindle-shaped toner base particles can be produced by removing the solvent. In addition, when substance soluble in acid and alkali such as calcium phosphate salt is used as a dispersion stabilizer, the calcium phosphate salt can be removed from the toner base particles by dissolving the calcium phosphate salt using an acid such as hydrochloric acid and rinsing with water thereafter, for example. It can be removed through other processes such as decomposition using enzymes.

(5) Then, a toner is obtained by implanting a charge control agent in the toner base particles obtained as above and externally adding thereto inorganic microparticles such as silica microparticles and titanium oxide microparticles. The implantation of the charge control agent and the external addition of inorganic microparticles are conducted by well-known methods using a mixer, etc., for example. Thereby, a toner with a small particle diameter and sharp particle diameter distribution can be easily obtained. Further, the strong agitation in the organic solvent removal process makes it possible to adjust the shape of the particles from a sphere to a rugby ball, and also adjust the surface morphology from smooth to wrinkled. The shape of the toner particles is quasi-spherical, and can be represented by the following shape specifications.

The toner produced above can be used as a one-component magnetic toner without utilizing a magnetic carrier, or as a non-magnetic toner. Moreover, if used in a two-component developer, the toner is best mixed with a magnetic carrier which is a ferrite containing a bivalent metal such as iron, magnetite, Mn, Zn, or Cu. A volume average particle diameter thereof is preferably 20 to 100 μm. With the average particle diameter being less than 20 μm, the carrier is likely to adhere to the photosensitive member 1 during development. When over 100 μm, the carrier is not mixed with the toner sufficiently, resulting in producing toner with insufficient charge and likely to cause unsatisfactory charge during continuous use. In addition, Cu ferrite containing Zn is preferable due to its high saturation magnetization, however, it can be selected properly according to the processing of the image forming apparatus.

Resins that cover the magnetic carrier are not particularly limited. Examples thereof include silicone resin, styrene-acrylic resin, fluorine-containing resin, and olefin resin. They are manufactured by dissolving coating resin in a solvent, and coating this on the core by spraying in a fluid layer, or by electrostatically adhering the resin particles to the nuclear particles and subjecting it to thermal fusion is conducted. The thickness of the resin to be coated is 0.05 to 10 μm, preferably 0.3 to 4 μm.

The image formation apparatus according to the present embodiment is configured to have the drum type image support body and an intermediate transfer body composed of the intermediate transfer belt, however, the image support body can be composed of no-end belt and the intermediate transfer body can be of a drum shape. Alternatively, the image support body on which the toner image is formed can be composed of the intermediate transfer body, and a transfer member to which the tone image is transferred can be composed of the recording paper 17. In this case, additionally provided are a cleaning blade to remove a remnant toner on the intermediate transfer body after the toner image transfer, and a lubricant coating device to coat a lubricant on the intermediate transfer body. Moreover, they are applicable to an image formation apparatus in which a toner image on an image support body made of a photoreceptor is directly transferred onto a recording paper.

(Charge Assembly)

The charge assembly 12 according to an embodiment of the present invention will be described with reference to FIGS. 3 to 8.

The charge assembly 12 according to the present embodiment includes a charge roller 12*a* (charge member) having a conductive support body 12*k* on which a resistance adjusting layer 12*m* and a surface layer 12*n* covering the resistance adjusting layer 12*m* are formed, and rotating a surface of the image support body 2Y to electrically charge the image support body 2Y, the surface layer having a static friction coefficient of 1.0 or more; and a cleaning member 12*b* rotating the surface layer of the charge roller 12*a* in contact therewith to remove foreign particles on the surface layer 12*n*.

The charge assembly 12 shown in FIG. 3 has the cleaning member 12*b* to remove attachments from the charge roller 12*a*. The cleaning member 12*b* can be of a roller type or a pad type, but the roller type is preferable. The charge roller 12*a* and the cleaning member 12*b* are provided on a plate 12*c* which has bearing plates 12*d*, 12*e* shown in the enlarged view of FIG. 4. The charge roller 12*a* is biased by a bias spring 12*f* towards a photoreceptor 11 and rotatably supported by the bearing plate 12*d*. In this structure, a fixed gap G to be described below can be formed between the photoreceptor 11 and the charge roller 12*a* even with occurrence of mechanic oscillation and deviation of a conductive support body (cored bar). Bias load is set to 4 to 25N, or preferably to 6 to 15N. This is because the gap G is greatly varied and falls outside a proper range sometimes due to the oscillation and eccentricity of the charge member during rotation, and unevenness of the surface thereof even when the charge member is supported by the bearing plate 12*d*.

The bearing plate 12*e* is swingably supported by an axe 12*g*. The cleaning member 12*b* is rotatably supported by the bearing plate 12*e*. The axe 12*g* is fixed to a standing portion 12*g*' of the plate 12*c*. The bearing plate 12*e* is biased towards the charge roller 12*a* by a coil spring 12*h*.

The cleaning member 12*b* is in contact with the charge roller 12*a* to clean the surface layer thereof. Foreign particles such as toner, paper powder, decomposition, or breakage of a component on the surface layer of the charge roller 12*a* have an electric field thereon concentratedly, so that they cause non-normal electric discharge. Conversely, foreign particles with electrical insulation attached on a wide area of the surface have less electric discharge thereon, causing unevenness of the electric charge on the image support body. Therefore, it is preferable to provide the cleaning member 12*b* to clean the surface of the charge roller 12*a*. The cleaning member 12*b* can be made of a brush of polyester fibers or the like, a porous matter (sponge) of melamine resin or the like.

It is preferable that circumferential velocity of the cleaning member 12*b* is the same as that of the charge roller 12*a*. The charge roller 12*a* is rotatably driven by a driver device via a not-shown gear. The cleaning member 12*b* can be configured to be made in contact with the charge roller 12*a* by friction and rotated following the rotation of the charge roller 12*a* or can be configured to be rotated by a not-shown gear in synchronization with the rotation of the charge roller 12*a*. Alternatively, the cleaning member can be configured to be moved away from charge roller 12*a* during stoppage of the rotation thereof and to be made in contact with the charge roller 12*a* before a start of the rotation thereof so that it can be rotationally driven intermittently.

With a difference in linear velocity between the circumferential velocity of the cleaning member 12*b* and that of the charge roller 12*a*, it is likely that the attached particles (foreign particles) on the surface layer of the charge roller 12*a* are forced to be pressed so that they cannot be removed.

The charge assembly is provided with a power supply source (not shown) to apply a voltage to charge roller 12*a*. The applied voltage may be a direct-current voltage alone, however, it is preferably to be a direct-current voltage superimposed on an alternating-current voltage. This is particularly true for the non-contact type image formation apparatus since a variation of the gap between the photoreceptor 11 and the charge roller 12*a* easily causes an unevenness of electric charge and the application of the direct-current voltage alone may cause an unevenness of a surface potential of the image support body. On the contrary, application of the direct-current voltage superimposed on the alternating-current voltage can make the surface of the charge roller 12*a* equipotential, thereby stabilizing the electric discharge thereof and allowing the image support body to be equally charged.

A peak voltage of the alternating-current voltage to be superimposed is preferably set to more than twice a charge start voltage of the image support body. The charge start voltage signifies an absolute value of a voltage of the image support body starting to be charged when the direct-current voltage alone is applied to the image charge roller 12*a*. This causes a reverse electric discharge from the image support body to the charge roller 12*a*, thereby enabling the image support body to be equally, stably charged.

In addition, it is preferable that the frequency of the alternating-current voltage is seven times or more higher than the circumferential velocity (process speed) of the image support body. Setting the frequency in such a manner can make moiré images visually unrecognizable.

According to the present embodiment, the cleaning member is a sponge roller made of melamine resin, and is forced to be made in contact with the charge roller 12*a* by a spring and is rotated by a friction.

Figure 5:
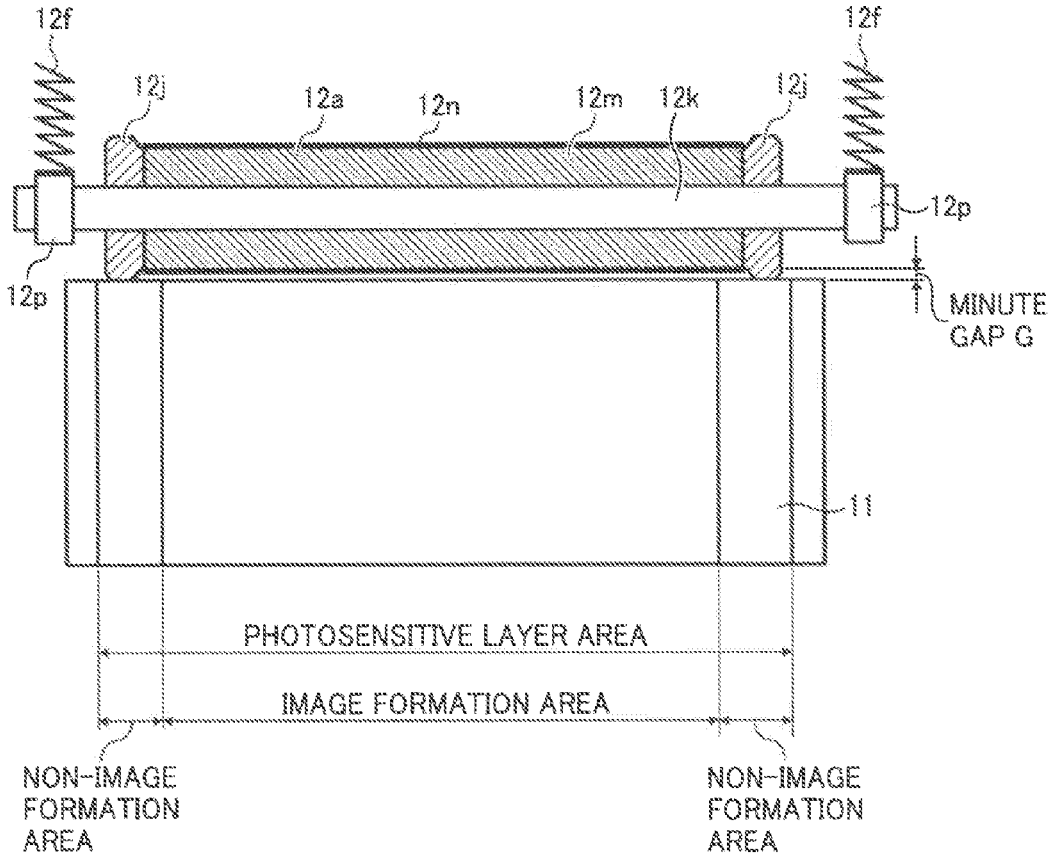
FIG. 5 is a pattern diagram of a non-contact type image formation apparatus.

FIG. 5 shows an example of the image formation apparatus of the non-contact electrification type including the charge member according to the present invention. Herein, a positional relationship among the photosensitive layer area, image formation area, and non-image formation area of the charge roller 12*a* and photoreceptor 11 is roughly shown.

The charge roller 12*a* as shown in FIG. 5 is disposed with a minute gap G (void) in opposition to the photoreceptor 11. The gap G between the charge roller 12*a* and the photoreceptor 11 is formed by having the gap holding member 12*j* abut with the non-image formation area of the photoreceptor 11. This can prevent a variation of the gap (void) G even with a variation of the thickness of the coating of the photosensitive layer. In the drawing, the code 12*p* represents a spring receiving member.

Figure 6:
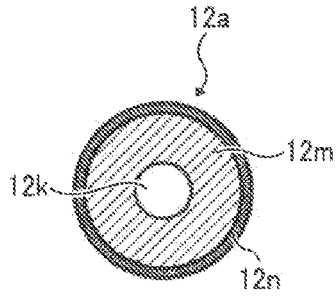
FIG. 6 is a cross-section view of the charge roller shown in FIG. 4.

The charge roller 12*a* has gap holding members 12*j* at both ends of the resistance adjusting layer 12*m* formed on the conductive support body 12*k*. The surface layer 12*n* is formed on the resistance adjusting layer 12*m* as shown in FIG. 6 in order to prevent attachment of the toner or toner additive thereon.

Figure 7:
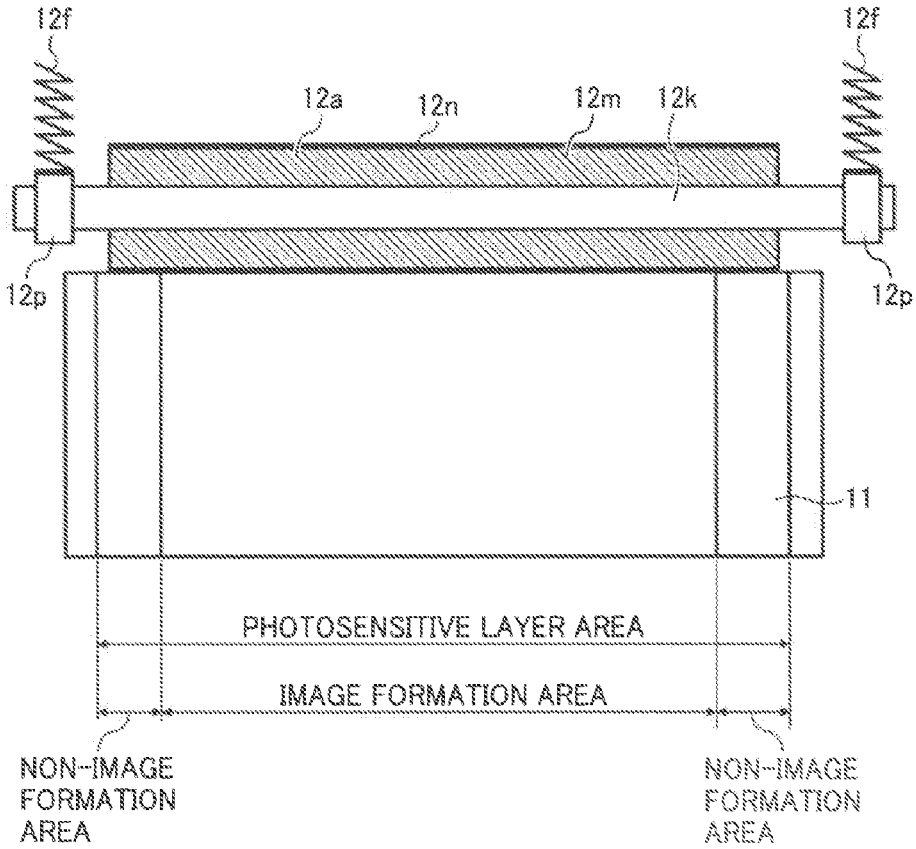
FIG. 7 is a pattern diagram of a contact type image formation apparatus.
Figure 8:
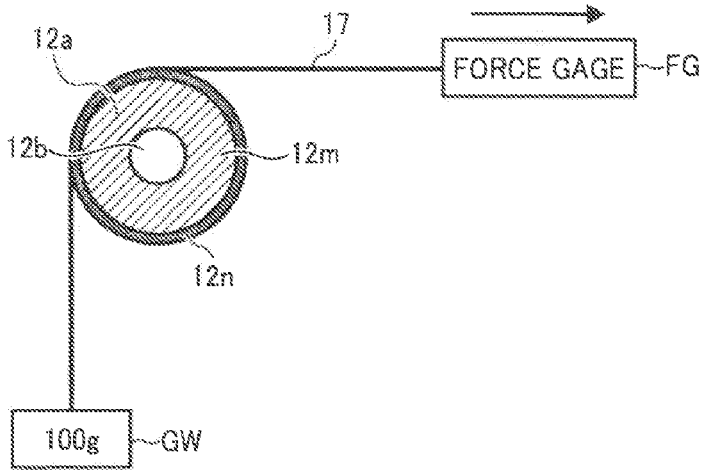
FIG. 8 is a pattern diagram showing an example of measuring a static friction coefficient according to Euler Belt method.

FIG. 7 shows an example of the image formation apparatus of the contact type including the charge member according to the present invention. The charge member has substantially the same components as those of the charge roller 12*a* of FIG. 5, except the gap holding members 12*j*.

The charge member may have a belt-like, blade-like or semi-cylindrical shape unlike the charge roller 12*a* with the cylindrical shape, and may be fixedly disposed. However, it preferably has a cylindrical shape as the charge roller 12*a*, and is rotatably supported by a gear or a bearing at both ends, as described above.

The charge member has a curved surface shape and is gradually moved forward/backward in the rotational direction of the photoreceptor 11, starting form a portion thereof closest to the photoreceptor 11, so that it can charge the photoreceptor 11 evenly. In a case where the charge member facing the photoreceptor 11 has a sharp portion, a local electric discharge will occur from the sharp portion due to its high potential thereof, making it difficult to evenly charge the photoreceptor 11.

Moreover, the surface of the charge member is subjected to a strong stress due to the discharge. When the discharge constantly occurs from the same portion of the surface, deterioration of the portion is advanced, causing a breakage of the portion. To prevent earlier deterioration of the charge member and elongate the longevity thereof, the charge member is rotated to discharge electricity from it entire surface.

(Gap G)

The gap G between the charge roller 12*a* and the photoreceptor 11 is set by the gap holding member 12*j* to 100 μm or less, particularly about 5 to 70 μm. This can prevent formation of defective images during the operation of the charge member. With the gap G over 100 μm, a discharge start voltage is increased according to Paschen's Law as a distance in which the electric discharge reaches the photoreceptor 11 is increased. Also, a discharge space between the charge roller 12*a* and the photoreceptor 11 is increased so that a large amount of discharge product is necessary to charge the photoreceptor 11 at a predetermined potential. However, when the discharge product of a large amount remains in the discharge space even after the image formation, it is attached to the photoreceptor 11, causing further deterioration of the photoreceptor 11 over time.

With a small gap G, a distance at which the electric discharge reaches the photoreceptor 11 is short, so the photoreceptor 11 is chargeable with small discharge energy. However, an air flow is worsen in the narrow space (discharge space) between the charge roller 12*a* and the photoreceptor 11. As a result, the discharge product of a large amount remains in the discharge space even after the image formation, similarly to the case when the gap G is large. The attachment of the discharge product to the photoreceptor 11 causes the deterioration of the photoreceptor 11 over time.

Accordingly, most preferable is to form a space sufficient to keep small the discharge energy and the amount of the discharge product and to prevent stagnant air flow. Thus, the gap G should be 100 μm or less, preferably 5 to 70 μm. This can prevent occurrence of a streamer discharge, reduce the amount of the discharge product generated and accumulated on the photoreceptor 11, and prevent spots and blurs on the images.

(Gap Holding Member)

A circumferential portion of the gap holding member 12*j* has a difference in height from the circumference of the resistance adjusting layer 12*m*. The gap G can be formed with a high precision by concurrently processing the gap holding member 12*j* and the resistance adjusting layer 12*m* through removing process such as cutout and polishing.

Moreover, a height of a portion of the gap holding member 12*j* adjacent to the resistance adjusting layer 12*m* is set to be lower than or equal to that of the resistance adjusting layer 12*m*, thereby reducing a width of a contacted portion of the charge roller 12*a* and the photoreceptor 11 to form the gap G between the gap holding member 12*j* and the photoreceptor 11 with a high precision. This can prevent the surface of an end portion of the gap holding member 12*j* close to the resistance adjusting layer 12*m* from abutting with the photoreceptor 11, and prevent occurrence of a leak current due to the resistance adjusting layer 12*m* made in contact with the photoreceptor 11 via the end portion.

Alternatively, when the end portion of the gap holding member 12*j* adjacent to the resistance adjusting layer 12*m* is set to be lower in height than the resistance adjusting layer 12*m*, the end portion can be used for an escape margin for a cutting knife or the like at the time of the removing process. The escape margin can be formed in any form as long as the surface of the end portion of the gap holding member 12*j* does not abut with the photoreceptor 11.

Moreover, for coating the surface layer 12*n* on the resistance adjusting layer 12*m*, it is difficult to control over masking at the border of the resistance adjusting layer 12*m* and the gap holding member 12*j*, considering a dispersion. However, the surface layer 12*n* can be properly formed on the resistance adjusting layer 12*m* by forming the surface layer 12*n* to have a thickness equivalent to the height of the resistance adjusting layer 12*m*, concurrently with setting the difference in height between the resistance adjusting layer 12*m* and the gap holding member 12*j*.

(Material of Gap Holding Member)

The gap holding member 12*j* needs to have such characteristics as to have the gap G stably formed between the photoreceptor 11 in a long period of time (over time) against environmental variations. Therefore, it is preferably made of materials with small absorption and small friction resistance. It is also essential for the gap holding member 12 to prevent the toner and toner additives from being attached thereto, and to prevent wear-out of the photoreceptor 11 by friction when slid in contact therewith.

Specifically, the materials of the gap holding member 12*j* are exemplified by general-purpose resins including polyethylene (PE), polypropylene (PP), polyacetal (POM), polymethylmethacrylate (PMMA), polystyrene (PS), their copolymers (AS, ABS), polycarbonate (PC), urethane, fluorine (PTFE), etc. The gap holding member 12*j* can be firmly fixed by an adhesive. Also, the gap holding member 12*j* is preferably made of materials with insulation performance of volume resistivity value of 1,013 Ωcm or more. The insulation performance is needed to prevent a leak current between the photoreceptor 11 and the gap holding member 12*j*. The gap holding member 12*j* is formed by molding.

(Materials of Resistance Adjusting Layer)

The resistance adjusting layer 12*m* is formed of a thermoplastic resin composition in which ion conductive polymers are dispersed. The volume resistivity value of the resistance adjusting layer 12*m* is preferably 106 Ωcm to 109 Ωcm. With the volume resistivity value of over 109 Ωcm, the resistance adjusting layer 12*m* cannot have sufficient chargeability and transferability, and with the volume resistivity value lower than 106 Ωcm, a leak current occurs on the entire photoreceptor 11 due to concentrations of the current.

There is no specific limitation on the thermoplastic resin used for the resistance adjusting layer 12*m*, however, general-purpose resins including polyethylene (PE), polypropylene (PP), polymethylmethacrylate (PMMA), polystyrene (PS), and their copolymers (AS, ABS), polyamide, and polycarbonate (PC) are preferable because they are easily molded.

The ion conductive polymers dispersed in the thermoplastic resin are preferably high polymer compounds containing polyether ester amide components. The polyether ester amide is an ion conductive polymer and is evenly dispersed and immobilized in a matrix polymer at a molecular level. Unlike compositions such as metallic oxide, carbon black in which electron conductive materials are dispersed, the ion conductive polymers do not show variations in the resistance due to insufficient dispersion. Also, with application of a high voltage to the electron conductive materials, a path through which electric current is likely to flow locally is formed therein, causing a leak current to the photoreceptor 11 and generation of defective images with white or black spots with the charge roller 12*a*. The polyether ester amide is a high molecular material so that it is unlikely to cause bleed-out. The necessary amount of the thermoplastic resin is 20 to 70% of part weight and that of the ion conductive material is 80 to 10% of part weight in order to obtain a desired resistance.

Moreover, for the purpose of adjustment of the resistance, electrolytes (salt) can be added to the materials of the resistance adjusting layer. The examples of salts are alkali metal salt such as sodium perchlorate, lithium perchlorate, lithium imide salt such as lithium bisimide, lithium trismethide, and quarternary phosphonium salt such as ethyl triphenyl phosphonium-tetrafluoroborate, tetraphenyl phosphonium bromide, etc. The conductive agent can be made of a single material or plural materials combined as long as its properties are maintained.

To disperse the conductive materials in the matrix polymer evenly at a molecular level, a compatibilizer may be used when appropriate. The addition of the compatibilizer enables micro-dispersion of the conductive materials. The compatibilizer containing a glycidyl methacrylate group as a reactive group can be used. Other additives such as anti-oxide agent can be also used as long as the properties of the conductive materials are maintained.

There is no specific limitation on the manufacturing method for the resin compositions. They can be easily manufactured by mixing, melting and kneading materials with a biaxial mixer, a kneader or the like.

Further, the resistance adjusting layer 12*m* can be easily formed on the conductive support body 12*k* by covering the conductive support body 12*k* with the conductive resin compositions by extrusion molding or injection molding.

When the charge roller 12*a* is composed of the conductive support body 12*k* having the resistance adjusting layer 12*m* only thereon, there may be a problem that the performance of the resistance adjusting layer 12*m* deteriorates because of attachment of the toner or toner additives thereto. Such a problem is preventable by forming the surface layer 12 on the resistance adjusting layer 12*m*.

Moreover, in the contact-type image formation apparatus, the charge roller 12*a* has to be an elastic body. In this case, to form an elastic resistance adjusting layer 12*m*, various conductive agents such as silicone, NBR, epichlorohydrin, EPDM or the like are added to rubber materials. The rubber materials can be processed by a known technique.

(Surface Layer)

In order to prevent the attachment of the toner, toner additives, or the like to the surface layer 12*n*, it is effective that the surface layer is made of highly non-adhesive resins such as fluorine and silicon. However, when used in the surface layer 12*n*, these materials have good slidability and low friction coefficients, so that the cleaning member 12*a* is likely to be slipped in contact with the surface layer 12*n* of the charge roller 12*a*. In particular, the slipping cleaning member 12*a* cannot remove not-easily removed, discharge-discomposed lubricant particles from the surface layer 12*n*, or worse, they may be attached firmly thereto.

In view of preventing the slipping of the cleaning member 12*b* in contact with the surface layer 12*n*, the static friction coefficient of the surface layer 12*n* of the charge roller 12*a* is set to a high value, thereby improving the removing performance of the cleaning member 12*b*.

Conventionally, the conductivity of the surface layer 12*n* has been made by a conductive agent such as carbon black. Such a conductive agent also functions as a solid lubricant so that it makes the static friction coefficient of the surface layer 12*n* low. This is the reason why the surface layer 12*n* of the charge roller 12*a* is given the conductivity by the ion conductive agent to have a high static friction coefficient.

Further, the use of the ion conductive agent reduces the occurrence of leak current and generation of images with white spots or black lines, compared with the use of carbon black as the conductive agent. This is because the ion conductive agent is dispersed at a molecular level while the carbon black as the conductive agent is dispersed at a much larger level. With the application of a high voltage, an electroconductive system as carbon black has a portion through which electric current is likely to flow locally. The leak current occurs from the portion. However, the ion conductive system by use of the ion conductive agent does not have such a portion due to minute dispersion therein, therefore, the leak current is not likely to occur. This is very significant in terms of the characteristics of electronic photographs. According to the present embodiment, with the use of the ion conductive agent, it is able to improve not only the cleanliness of the surface layer 12*n* but also a margin of the electric discharge.

(1) Ion Conductive Agent

To form the surface layer 12*n* of the ion conductive system, it is necessary to disperse the ion conductive agent in the surface layer. The ion conductive agent is, for example, quaternary ammonium salt, surfactants, alkali metal, alkali earth metal containing salt and so on. Surfactants are general ion conductive agents, however, they are not suitable for use in this case because they tend to bleed out from inside to the surface, and may cause the attachment of the toner and contamination on the photoreceptor. With use of the quaternary ammonium salt, sufficient resistance for the charge roller 12*a* is not attainable.

Accordingly, preferable ion conductive agents for the charge roller 12*a* are ones containing alkali metal or alkali earth metal containing salt. The ion conductive agent is dispersed in a matrix polymer or the like to form a thin film by coating. Then, to reduce the resistance by ion conductivity, polyether binding is needed in the matrix polymer, in which metallic ions of the ion conductive agent is coordinated with oxygen atoms of polyether in the matrix polymer. This makes the ions easily movable, and the electric current more flowing to decrease the resistance. Examples of the alkali metal and alkali earth metal containing salt are alkali metal salt such as sodium perchlorate, lithium perchlorate, kalium perchlorate, or perchlorate such as magnesium perchlorate, or calcium perchlorate.

Fluorine containing organic anion salts are, for example, alkali metal salt and alkali earth metal salt such as perfluoroalkane sulfonate, bis(perfluoroalkanesulfonyl) imide acid, tris(perfluoroalkanesulfonyl) methide acid. The perfluoroalkane sulfonate is, for example, lithium trifluoromethane sulfonate (CF3SO3Li), lithium perfluoroethane sulfonate (C2F5SO3Li), and lithium perfluorobuthane sulfonate (C4F9SO3Li).

The bis(perfluoroalkanesulfonyl) imide salt is, for example, imide lithium bis(trifluoromethane sulfonate) ((CF3SO2)2NLi), imide lithium bis(perfluoroethane sulfonate) ((C2F5SO2)2NLi), and imide lithium bis(perfluorobuthane sulfonate) ((C4F9SO2)2NLi). Also, the tris(perfluoroalkanesulfonyl) methide salt is, for example, tris (trifluoromethanesulfonyl) lithium methide acid ((CF3SO2)3CLi), tris(perfluoroethanesulfonyl) lithium methide acid ((C2F5SO2)3CLi), and tris(perfluorobuthanesulfonyl) lithium methide acid ((C4F9SO2)3CLi). These perchlorates and fluorine containing organic anion salts can be used alone or in combination of two or more kinds in accordance with the resistance level of the charge roller 12*a*.

The matrix polymer is exemplified by polyethylene oxide, polypropylene oxide, polyethylene oxide-polypropylene oxide copolymer, polyetherpolyol containing ether binding and hydroxyls in a molecule composed of a polyethylene-polyethyleneglycol graft copolymer. Adding the perchlorates and fluorine containing organic anion salts to the polyetherpolyol can increase conductivities. Generally, relative to the polyetherpolyol of 100 weight parts, 0.1 to 50 weight parts of the perchlorates and fluorine containing organic anion salts are added in total. With safe handling thereof taken into consideration, the additive amount of the perchlorates is to be 20 weight parts at a maximum.

Note that in the ion conductive system, the ion conductive agents have no color, and colorants such as pigments and dyes are addable thereto as long as functions and properties of the conductive member are maintained.

(Method of Forming Surface Layer 12*n*)

To form the surface layer 12*n* on the resistance adjusting layer 12*m*, a coating material is prepared by melting components of the surface layer 12*n* in an organic solvent, and the coating material is coated on the resistance adjusting layer 12*m* by various coating methods as spray coating, dipping, and rollcoating. The thickness of the layer is preferably about 5 to 30 μm.

The polyetherpolyol having the perchlorates and fluorine containing organic anion salts added thereto is fluid, which cannot be solidified on the resistance adjusting layer 12*m*. To form a thin film from this fluid, the polyetherpolyol need be hardened with a curative agent through condensation and cross-linking. Isocyanate resins are an effective curative agent which makes cross-link reaction with a base compound containing hydroxyls in a molecule and with the hydroxyls.

The isocyanate resins are exemplified by polyisocyanate resin, for example, 2,4-triene diisocyanate, diphenylmethane-4,4'-diisocyanate, xylylene diisocyanate, isophorone diisocyanate, lysine methyl ester diisocyanate, methyl cyclohexyl diisocyanate, trimethyl hexamethylene diisocyanate, hexamethylene diisocyanate, n-pentane 1,4-diisocyanate, and their trimers, adductors, biurets, and polymers containing two or more isocyanate groups, and blocked isocyanates. However, the isocyanate resins not limited to the above examples.

The cross-linking and hardening reaction occur in the fluid by the curative agent of isocyanate resin at a relatively low temperature of 100° C. or less. The amount of the curative agent is preferably 0.1 to 5 equivalent weight per equivalent of a functional group (—OH group), preferably 0.5 to 1.5 equivalent weight. Additionally, curative agents of amino resins such as melamine, guanamine resin can be used when appropriate according to heat resistance of a base material.

In consideration of the charge roller 12*a* made in contact with the surface layer 12*n*, photoreceptor, and toner, the surface layer 12*n* is preferably made of silicon resins or fluorine resins since it is required to have nonadhesivity (water/oil repellency). It is advantageous to form the surface layer 12*n* using such resins in terms of durability by condensing and cross-linking the silicon resins or fluorine resins containing hydroxyls in a molecule with the curative agent, similarly to the polyetherpolyol.

Generally, the friction coefficient of the surface layer made of the silicon resins or fluorine resins is low because of the properties of these resins. However, the addition of the ion conductive agent containing the polyetherpolyol enables a high friction coefficient of the surface with water and oil repellency.

With the use of the curative agent, the condensing and cross-linking reaction by heating may take a time to occur depending on a kind of polyol resin (containing hydroxyls), isocyanate, or the like. In order to improve productivity, the coating film needs to be fixed in a shorter reaction time, and the addition of a catalyser can facilitate the reaction. The catalyser can be metallic catalysers such as stannum, aluminum, or zirconium, or organic catalysers such as a combination of tertiary amine, DBU (1,8-diazabicyclo(5,4,0)undecene-7) or DBU (1,5-diazabicyclo(4,3,0)nonene-5) and acids. They can be used when appropriate.

Hereinafter, the examples of the present invention will be described.

EXAMPLES AND COMPARATIVE EXAMPLES

Preparation of Resistance Adjusting Layer 12*m* (1)

A resin compound is prepared by melting and kneading 40% of part weight of ABS resin (GR 3000, manufactured by Denka Corporation), 60% part weight of polyether ester amide (IRGASTAT P18, manufactured by Chiba Japan K. K.), four copolymers of polycarbonate-glycidylmethacrylate-stylene acrylonitrile (Modiper CL440-G, manufactured by NOF Corporation) relative to a total resin amount 100. The prepared resin compound is molded on the conductive support body 12*k* (external diameter 10 mm) made of SUM (Ni coated) by injection, thereby forming the resistance adjusting layer 12*m*.

Then, after gate-cutting and length adjustment, ring-shaped gap holding members 12*j* (high-density polyethylene resin, Novateck PP HY540, manufactured by Japan Polychem Corporation) are pressure-fitted on both ends of the resistance adjusting layer 12*m*. The gap holding members 12*j* and the resistance adjusting layer 12*m* are cut at the same time to have their external diameters at 12.5 mm, 12.4 mm, respectively.

Coating materials made of mixtures shown in Table 1 are coated on the thus-formed resistance adjusting layer 12*m* by spray coating to form the surface layer 12*n* with a thickness of about 10 μm. Thereafter, it is harden in a hot oven with heat of 105° C. for 60 minutes to form the charge roller 12*a* having the gap holding member 12*j* and the surface layer 12*n* with a difference in height of about 40 μm therebetween. The charge roller 12*a* is used in the image formation apparatus of the non-contact type.

Preparation of Resistance Adjusting Layer 12*m* (2)

Through extrusion molding and vulcanization, the conductive support body 12*k* made of stainless (core axis with external diameter 8 mm) is covered with the resistance adjusting layer 12*m* as a rubber composition in which 100 weight parts of epichlorohydrin rubber (Epichlomer CG, manufactured by Daiso Co. Ltd.) are compounded with 3 weight parts of ammonium perchlorate. The resultant conductive support body 12*k* is polished until the external diameter thereof becomes 12 mm, to thereby form the charge roller 12*a*. This charge roller 12*a* is used in the image formation apparatus of the contact type.

Note that the static friction coefficient is measured for the surface layer 12*n* in each of the Examples and Comparative examples. The measurement of the static friction coefficient is performed by Euler belt method shown in FIG. 8. The maximum static friction coefficient μμ is measured as follows. A weight GW is attached to one side of the recording paper 17 (RICOH 6200) and a force gage FG is attached to the other side thereof. While the charge roller 12*a* is made in contact with the recording paper 17, the force gage FG is pulled in a direction of the arrow in FIG. 8, to measure as a measured value f the static friction coefficient of the recording paper 17 starting sliding. The maximum static friction coefficient μμ is expressed by $$\mu\mu = Ln(f/g)/(\pi/2),$$

where g is a weight of GW (100 g), and Ln is natural logarithm of a numeric value.

(Test)

The charge roller 12*a* is incorporated into the process cartridge shown in FIG. 3, and the process cartridge is installed into the image formation apparatus (Imagio MP C3000 by RICOH Co. Ltd.). Then, with the use of the image formation apparatus having the process cartridge, images with area ratio of 5% (horizontal A4 size paper) are continuously formed. A halftone image A3 in 2×2 size and 600 dpi is outputted in every 10,000 sheets of paper for evaluation and visually checked whether or not vertical lines occur thereon.

Figure 9:
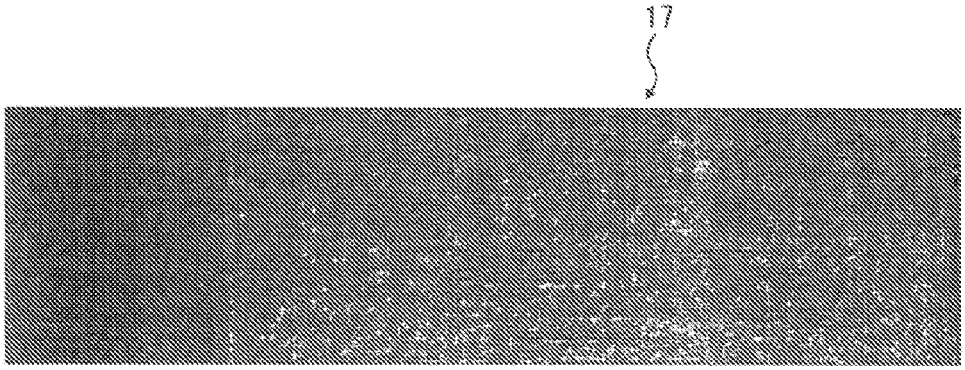
FIG. 9 shows a part of the recording paper when the charge roller is free from blots.
Figure 10:
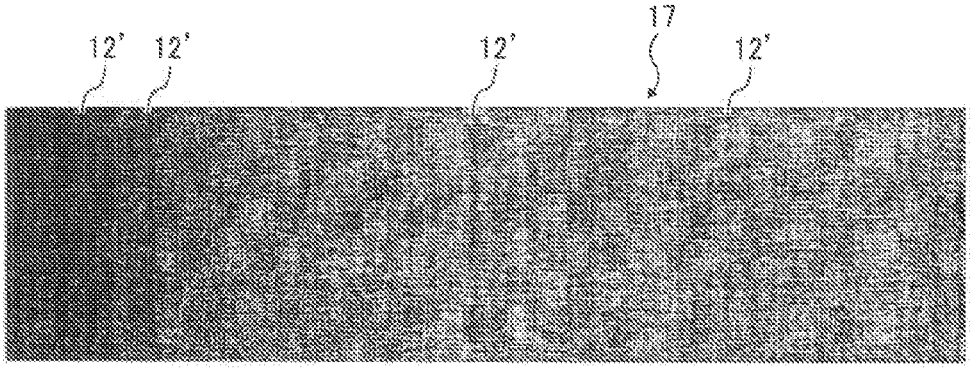
FIG. 10 shows a part of the recording paper on which vertical lines appear because of the blots on the charge roller.

FIG. 9 shows a part of the recording paper 17 when the charge roller 12*a* is clean, and FIG. 10 shows a part of the recording paper 17 having vertical lines thereon when the charge roller 12 is dirty.

Here, in order to advance the uncleanliness of the surface layer 12*n* of the charge roller 12*a*, the amount of coating of zinc stearate on the surface is increased. The load for the compressed coil spring 37 of FIG. 3 is changed from generally set 5.5N to 8N for the check-up of occurrence of vertical lines. In this test, when vertical lines appear on an image with image formation of 80,000 (80 k) sheets or less of the recording paper 17, it is evaluated as defective (x). When no vertical line appears on an image with repetitive image formation of 80,000 (80 k) sheets thereof, it is evaluated as good (○). The images are outputted in a general environment at temperature 20 to 25° C., relative humidity 30 to 60% RH.

TABLE 1

| | Resistance Adjusting Layer | Conductive Agent/ Matrix Polymer | Amount of Conductive Agent(wt %) | Resin | Hardener | Static Friction Coefficient | Image with Lines (Sheets) | Evaluation |
|---|---|---|---|---|---|---|---|---|
| Example 1 | (1) | Perchlorate Li/PEO-PRO (Copolymer) (1) | 6 | Silicon Acrylate (6) | Polyisocyanate resin (7) | 1.59 | 100 | ○ |
| Example 2 | (1) | Perchlorate Li + TFMS-Li/PEO-PRO (Copolymer) (2) | 10 | Silicon Acrylate (6) | Polyisocyanate resin (7) | 1.1 | 100 | ○ |
| Example 3 | (1) | Li + TFMS-Li/PEO-PRO (Copolymer) (3) | 7.5 | Fluorine (8) | Polyisocyanate resin (9) | 1.53 | 90 | ○ |
| Example 4 | (1) | Li imide/PEO (4) | 30 | Silicone Fluorinate (10) | Polyisocyanate resin (11) | 1.05 | 80 | ○ |
| Example 5 | (2) | Perchlorate Li/PEO-PRO (Copolymer) (1) | 6 | Silicon Acrylate (6) | Polyisocyanate resin (7) | 1.59 | 80 | ○ |
| Example 6 | (2) | Li + TFMS-Li/PEO-PRO (Copolymer) (3) | 7.5 | Fluorine (8) | Polyisocyanate resin (9) | 1.53 | 80 | ○ |
| Comparative Example 1 | (1) | Carbon Black/— | 25 | Silicon Acrylate (7) | Polyisocyanate resin (8) | 0.19 | 40 | x |
| Comparative Example 2 | (1) | Carbon Black/— | 30 | Urethane (12) | Polyisocyanate resin (13) | 0.51 | 30 | x |
| Comparative Example 3 | (1) | ITO/— (5) | 63 | Polyester (14) | Benzoguanamine (15) | 0.4 | 30 | x |
| Comparative Example 4 | (2) | Carbon Black/— | 25 | Fluorine (16) | Polyisocyanate resin (17) | 0.16 | 40 | x |
| Comparative Example 5 | (2) | ITO/— (5) | 63 | Polyester (14) | Polyisocyanate resin (15) | 0.4 | 20 | x |

Notes:
(1) PEL-20A, manufactured by Japan Carlit Co. Ltd.
(2) PEL-AK1 (TFMS; trifluoromethanesulfonic acid), manufactured by Japan Carlit Co. Ltd.
(3) PEL-25, manufactured by Japan Carlit Co. Ltd.
(4) PEO-30R, manufactured by Sanko Chemical Ind. Co. Ltd.
(5) EC700, manufactured by Titan Kogyo Co. Ltd
(6) MukiCoat 3000VH, manufactured by Kawakami Paint Co. Ltd.
(7) T4 hardener, manufactured by Kawakami Paint Co. Ltd.
(8) Surfcure DSC-201, manufactured by Daido Corporation
(9) Surfcure Hardner K-20, manufactured by Daido Corporation
(10) ZX022, manufactured by Fuji Kasei Co. Ltd.
(11) Duranate MF-B60X, manufactured by Asahi Kasei Chemicals Corporation
(12) Neo-Polynar No. 800(s), manufactured by Ohashi Chemical Industries, Ltd.
(13) Neo-Polynar No. 800(s) Hardener E, manufactured by Ohashi Chemical Industries, Ltd.
(14) Byron 20SS/30SS, manufactured by Toyobo Co. Ltd.
(15) BL-60, manufactured by Sanwa Chemical Co. Ltd
(16) Lumifuron 601C, manufactured by Asahi Glass Co. Ltd.
(17) Lumifuron 601C Hardener, manufactured by Asahi Glass Co. Ltd.

Figure 11:
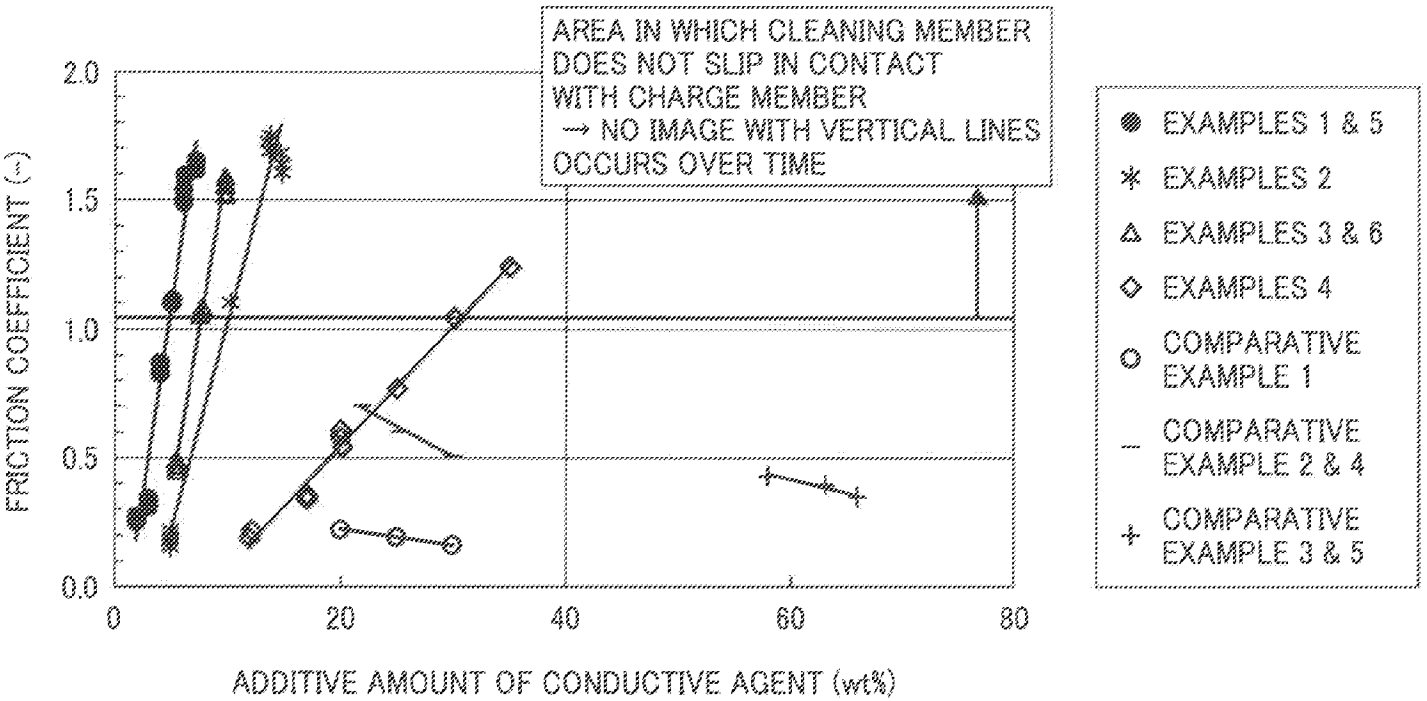
FIG. 11 is a graph showing a relationship between an additive amount of a conductive agent and a static friction coefficient.

FIG. 11 shows a graph representing a relationship between the additive amount of the conductive agent and the static friction coefficient according to the Table 1.

As shown in FIG. 11, with regard to the charge roller in each example, the static friction coefficient increases as the additive amount of the ion conductive agent increases. To the contrary, in each comparative example, the static friction coefficient decreases as the additive amount of the carbon black conductive agent increases.

As obvious from the Table 1, with the use of the image formation apparatus incorporating the charge roller 12*a* (Examples) with the surface layer 12*n* of the static friction coefficient of 1.0 or more, there is no vertical line appearing on the paper during development of less than 80,000 sheets. On the other hand, with the use of the image formation apparatus incorporating the charge roller 12*a* (Comparative Examples) with the surface layer 12*n* of the static friction coefficient of less than 1.0, vertical lines always appear on the paper during development of less than 80,000 sheets.

Figure 12:
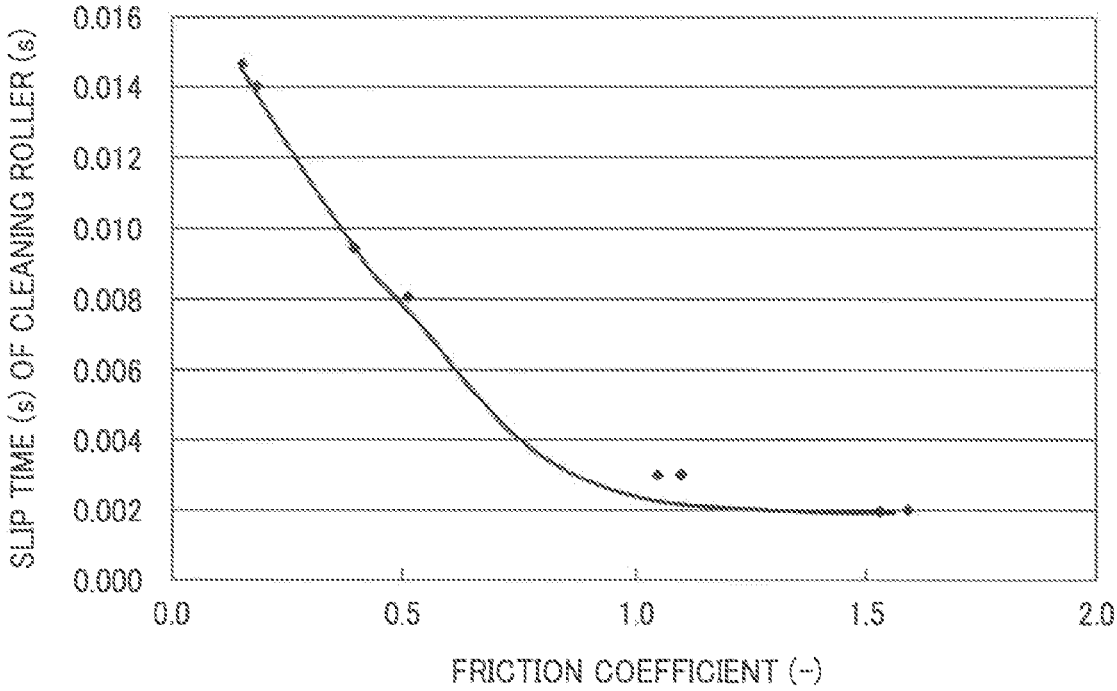
FIG. 12 is a graph showing a relationship between the static friction coefficient and a slip time which is time from a start of a charge roller's rotation to a start of a cleaning member's rotation in accordance with the rotation of the charge roller.

Next, FIG. 12 shows a curve Q representing a relationship between the static friction coefficient and a time (slip time) from start of rotation of the charge roller 12*a* to start of rotation of the cleaning member (cleaning roller) 12*b* following the rotation of the charge roller 12*a*, in the charge assembly used in the Examples and Comparative Examples.

The curve Q shows that at the static friction coefficient of less than 1.0, slip time is 2 ms to 3 ms or more while at the static friction coefficient of 1.3 or more, the slip time is less than 2 ms. The slip time is stable at the static friction coefficient of 1.00 or more. According to the curve Q of FIG. 12 and the Examples in the Table 1, preferably, the surface layer 12*n* of the charge roller 12*a* has the static friction coefficient of 1.0 or more to 2.0 or less, more preferably 1.53 or more to less than 1.60.

As described above, according to the embodiment of the present invention, it is possible to prevent the cleaning member from slipping in contact with the charge member without fail, so that the cleaning member can remove the attachments on the surface layer of the charge member more surely and improve the cleaning performance. Accordingly, the image formation apparatus incorporating the charge assembly according to the invention can generate images in high image quality over a long period of time.

Note that heretobefore, it has been considered that the static friction coefficient of the surface layer of the charge member should be preferably small in order to prevent the toner with high adherence from being attached on the surface layer of the charge member. However, the inventors of the present invention have decided to use the materials with the high static friction coefficient of 1.0 or more for the surface layer thereof. This is because the inventors have found out through experiments and analysis that the slip time (difference in linear velocity) between the charge member and the cleaning member during the rotation of the charge member causes the cleaning member not to remove the attachments from the surface layer but to firmly attach them thereon, which causes the generation of defective images.

According to the present embodiment, with the use of the materials of the surface layer with the static friction coefficient of 1.0 or more, the toner and external additive can be prevented from being attached on the surface layer. Moreover, the adherence of the surface layer can be reduced and the anti-friction performance thereof can be also improved.

The ion conductive surface layer according to the present invention is suitable for increasing the static friction coefficient. Also, the conductive mechanism can be of the ion conductive system so that the local concentration of the electric charge and the non-normal electric discharge can be prevented. Accordingly, it is able to provide the charge member with the same level of resistance as that of the conventional charge member as well as high friction coefficient and to prevent the non-normal electric discharge.

Moreover, forming the charge member in the cylindrical form makes it possible to prevent the electric discharge from the same portion, resulting in lengthening the longevity of the components thereof. Also, the charge member is configured to be rotated in contact with the cleaning member, thereby further improving the cleaning performance of the cleaning member.

Further, in the charge assembly according to the present invention, the application of both of the direct-current voltage and alternating-current voltage can prevent unevenness of the electric charge and provide stable electric charge to the image support body over a long period of time.

Further, the cleaning member is formed of a porous melanin resin or a sponge material so that the pores thereof absorb in the attachments on the surface layer of the cleaning member, which can prevent already-removed attachments on the charge member from re-attaching thereto. Moreover, the circumferential velocity of the cleaning member and that of the charge member are set to be the same so that the attachments on the surface layer of the charge member can be removed without being pressed down and spread.

Furthermore, disposing the charge member in non-contact with the image support body makes it possible to reduce the amount of attached particles as the remnant toner, external additive, lubricant, and their decompositions on the charge member, realizing the extension of the longevity of the charge member. Also, coating the solid lubricant on the image support body makes it possible to prevent the wear-out of the image support body by friction and improve the removability of the toner and external toner additive attached thereon, and acquire images with high image quality over a long period of time.

Note that the term, "image support body" herein refers to conceptual objects represented by a photoreceptor, a transfer belt or the like.

Although the present invention has been described in terms of exemplary embodiments, it is not limited thereto. It should be appreciated that variations may be made in the embodiments described by persons skilled in the art without departing from the scope of the present invention as defined by the following claims

What is claimed is:

1. A charge assembly, comprising:

a rotating charge member disposed to face an image support body with a gap, the rotating charge member having a conductive support body on which a resistance adjusting layer and a surface layer are formed, and to electrically charge the image support body, the surface layer covering the resistance adjusting layer, containing a conductive agent having an additive amount of 20 wt % or less and having a static friction coefficient within a range of 1.1 to 1.59, the image support body having an electrostatic latent image formed thereon; and a cleaning member rotating on the surface layer of the charge member having the static friction coefficient, in contact therewith to remove a foreign particle attached to the surface layer of the charge member.

2. A charge assembly according to claim 1, wherein the surface layer is made of a resin material which includes resin containing fluorine or silicon.

3. A charge assembly according to claim 2, wherein the resin containing fluorine or silicon includes hydroxyl, and is condensed by a curing agent to form a condensed product.

4. A charge assembly according to claim 1, wherein a resin material of which the surface layer is made is formed of resin in which an ion conductive agent and polyether-polyol resin are condensed by a curing agent, the ion conductive agent including alkaline metal or alkaline earth metal.

5. A charge assembly according to claim 1, wherein the charge member has a cylindrical shape.

6. A charge assembly according to claim 1, wherein a direct-current voltage and an alternating-current voltage are applied to the charge member.

7. A charge assembly according to claim 1, wherein the cleaning member is made of porous melamine resin.

8. A charge assembly according to claim 1, wherein the cleaning member is made of a sponge material.

9. A charge assembly according to claim 1, wherein the static friction coefficient of the surface layer is at least 1.53.

10. A charge assembly according to claim 1, wherein a circumferential velocity of the cleaning member and a circumferential velocity of the charge member are equal.

11. A charge assembly according to claim 1, wherein the cleaning member is rotated in accordance with rotation of the charge member.

12. A charge assembly according to claim 1, wherein the additive amount of the conductive agent is 10 wt % or less.

13. An image formation apparatus, comprising:

an image support body supporting an electrostatic latent image;

an exposure part exposing a surface of the image support body to write an electrostatic latent image to the surface of the image support body;

a developing part visualizing the electrostatic latent image formed on the surface of the image support body;

a transfer part transferring a visualized image on a transfer body;

a surface cleaning part cleaning the surface of the image support body;

a lubricant coating member coating a lubricant on the surface of image support body for preventing the surface of the image support body from cracking;

a charge assembly comprising a charge member having a conductive support body on which a resistance adjusting layer and a surface layer are formed, and rotating on a surface of the image support body to electrically charge the image support body, the surface layer covering the resistance adjusting layer, containing a conductive agent having an additive amount of 20 wt % or less and having a static friction coefficient within 1.1 to 1.59; and a cleaning member rotating on the surface layer of the charge member having the static friction coefficient, in contact therewith to remove a foreign particle attached to the surface layer of the charge member, wherein the charge member is disposed to face the image support body supporting a latent image with a gap.

14. An image formation apparatus according to claim 13, wherein:

the image support body is coated with a lubricant, and the lubricant includes alkaline metal or alkaline earth metal.

* * * * *